US010527993B2

(12) United States Patent
Itoh

(10) Patent No.: US 10,527,993 B2
(45) Date of Patent: Jan. 7, 2020

(54) IMAGE FORMING APPARATUS, SYSTEM INCLUDING SAME, TERMINAL APPARATUS INCLUDED IN SYSTEM, AND METHOD FOR DISPLAYING LIMIT INFORMATION IN IMAGE FORMING APPARATUS

(71) Applicant: Sharp Kabushiki Kaisha, Sakai, Osaka (JP)

(72) Inventor: Kenji Itoh, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/420,352

(22) Filed: May 23, 2019

(65) Prior Publication Data

US 2019/0278211 A1 Sep. 12, 2019

Related U.S. Application Data

(63) Continuation of application No. 14/834,497, filed on Aug. 25, 2015, now abandoned.

(30) Foreign Application Priority Data

Sep. 4, 2014 (JP) ..... 2014-180481

(51) Int. Cl.
*G03G 15/00* (2006.01)

(52) U.S. Cl.
CPC ..... *G03G 15/5091* (2013.01); *G03G 15/502* (2013.01)

(58) Field of Classification Search
CPC ..... G03G 15/502; G03G 15/5091
See application file for complete search history.

(56) References Cited

U.S. PATENT DOCUMENTS 8,190,048 B2 * 5/2012 Suzuki ..... G03G 15/5016 399/79
8,411,328 B2 * 4/2013 Tsuchitoi ..... G03G 21/04 283/113
8,593,658 B2 * 11/2013 Sato ..... G06F 3/1204 358/1.14

(Continued)

FOREIGN PATENT DOCUMENTS

JP 2012145707 A * 8/2012

OTHER PUBLICATIONS

Itoh, "Image Forming Apparatus, System Including Same, Terminal Apparatus Included in System, and Method for Displaying Limit Information in Image Forming Apparatus", U.S. Appl. No. 14/834,497, filed Aug. 25, 2015.

*Primary Examiner* — Carla J Therrien
(74) *Attorney, Agent, or Firm* — Keating & Bennett, LLP

(57) ABSTRACT

An image forming apparatus is capable of setting a plurality of limiting conditions for each user. The image forming apparatus includes a hard disk drive (HDD) that stores a limiting condition set for each user, a touch panel that accepts input of an instruction from a user, a central processing unit (CPU) that determines whether a limiting condition is stored in the HDD in association with the user in response to the instruction from the user, and a display panel that displays limit information indicating details about limitation corresponding to the limiting condition in response to the CPU determining that the limiting condition is stored in the HDD.

13 Claims, 15 Drawing Sheets

(56) References Cited

U.S. PATENT DOCUMENTS 8,755,075 B2 * 6/2014 Nonaka ..... G06K 15/002 358/1.12
8,896,882 B2 * 11/2014 Nakata ..... H04N 1/04 358/1.15
2004/0141203 A1 * 7/2004 Honma ..... G06F 3/1205 358/1.15
2004/0258429 A1 * 12/2004 Moroi ..... G06F 21/629 399/80
2006/0065715 A1 * 3/2006 Kojima ..... G06Q 20/32 235/380
2006/0187486 A1 * 8/2006 Tsuchitoi ..... G06F 3/1204 358/1.15
2006/0275064 A1 * 12/2006 Minari ..... G03G 21/04 399/366
2007/0229873 A1 * 10/2007 Kato ..... G06F 3/1219 358/1.14
2007/0253014 A1 * 11/2007 Nakata ..... G06F 3/1219 358/1.14
2008/0028448 A1 * 1/2008 Tsuchitoi ..... G06F 3/1214 726/6
2008/0137134 A1 * 6/2008 Igarashi ..... G06F 21/608 358/1.15
2009/0228822 A1 * 9/2009 Miyata ..... G03G 15/5016 715/771
2011/0002003 A1 * 1/2011 Suwabe ..... G06F 21/629 358/1.14
2011/0188073 A1 * 8/2011 Akutsu ..... G06F 15/00 358/1.15
2012/0019861 A1 * 1/2012 Okada ..... G03G 15/5016 358/1.15
2012/0099131 A1 * 4/2012 Tani ..... G03G 15/502 358/1.13
2013/0107310 A1 * 5/2013 Kodama ..... G03G 15/5004 358/1.14
2014/0098400 A1 * 4/2014 Kaneko ..... G03G 15/50 358/1.15

* cited by examiner

IMAGE FORMING APPARATUS, SYSTEM INCLUDING SAME, TERMINAL APPARATUS INCLUDED IN SYSTEM, AND METHOD FOR DISPLAYING LIMIT INFORMATION IN IMAGE FORMING APPARATUS

BACKGROUND

1. Field

The present disclosure relates to an image forming apparatus capable of limiting the use of the image forming apparatus by a logged-in user, and more particularly to an image forming apparatus capable of displaying limit information indicating details about limitation in the case where the use of the image forming apparatus by a user is limited, a system including the image forming apparatus, a terminal apparatus included in the system, and a method for displaying the limit information in the image forming apparatus.

2. Description of the Related Art

Image forming apparatuses (typically, copiers) that form an image on a recording medium are installed at many business establishments (such as companies and offices) as a type of image processing apparatuses, that is, electronic devices. Multifunction peripherals (MFPs), which are a type of such image forming apparatuses, have a plurality of function modes such as a copy mode, a fax mode, a communications network (hereinafter, also simply referred to as a network) print mode, and a scan mode. Such image forming apparatuses are shared among a plurality of users in a network-connected state or in a standalone state without being connected to a network.

Recently, there have become available information forming apparatuses capable of limiting functions used by users in order to reduce the cost. For example, image forming apparatuses that support color printing are capable of setting various limitations, such as limiting the function to only black-and-white printing and limiting the number of recording media used for printing.

Japanese Unexamined Patent Application Publication No. 2012-145707 discloses an image forming apparatus having a function for setting a limit on the number of sheets printed. The image forming apparatus calculates the number of sheets to be used if an image of a specified original is printed. The image forming apparatus then determines whether the sum of the calculated number of sheets to be used and the total number of sheets having been used exceeds the limit. If the sum exceeds the limit, the image forming apparatus displays a condition under which printing is permitted. For example, N-in-1 printing or two-sided printing is displayed as the condition. Such information helps a user avoid printing limitation even if the sum exceeds the limit and makes it easier for the user to perform printing.

In the case where an image forming apparatus capable of setting a plurality of limitations on the use of the image forming apparatus for each user displays a message indicating that printing is prohibited in response to the user inputting an instruction to perform printing after logging into the image forming apparatus and setting printing settings, such a message does not indicate which limitation prohibits the use of the image forming apparatus. Every limitation settable by the image forming apparatus can be the possible cause. For example, all users may be prohibited from using the image forming apparatus, the user may be prohibited from using the image forming apparatus because the number of sheets that have been used by user has exceeded the limit, the use of color printing alone may be prohibited, or the use of the image forming apparatus may be prohibited regardless of the type of printing (color or black-and-white printing). As a result, the number of inquiries to the administrator undesirably increases. In addition, in the case where lifting the limitation requires submission of a request, the user may submit a request for an incorrect limitation-lifting action, which undesirably hinders the administrator from taking a suitable action. If the user is required to re-submit a request, the procedure becomes more troublesome.

It is challenging to deal with such issues with the technique disclosed in Japanese Unexamined Patent Application Publication No. 2012-145707.

SUMMARY

It is desirable to provide an image forming apparatus capable of limiting the use of the image forming apparatus by a logged-in user and capable of displaying limit information indicating details of limitation in the case where the use of the image forming apparatus by a user is limited, a system including the image forming apparatus, a terminal apparatus included in the system, and a method for displaying the limit information in the image forming apparatus.

An image forming apparatus according to a first aspect of the present disclosure has a user authentication function and is capable of limiting use of the image forming apparatus by a user who has passed user authentication. The image forming apparatus includes a storage unit that stores a limiting condition set for each user, the limiting condition being a condition for limiting use of the image forming apparatus; an input unit that accepts input of an instruction from the user; a determining unit that determines, in response to the input unit accepting the instruction from the user, whether the storage unit stores a limiting condition set for the user; and a display unit that displays, in response to the determining unit determining that the storage unit stores the limiting condition set for the user, limit information indicating details about limitation corresponding to the limiting condition determined to be stored in the storage unit. The storage unit is capable of storing, for each user, a plurality of limiting conditions.

A system according to a second aspect of the present disclosure includes an image forming apparatus and a server computer having a user authentication function. The image forming apparatus includes an input unit that accepts input of a user identity, and a communication unit that sends the input user identity to the server computer and receives information associated with the user identity from the server computer. The server computer includes a storage unit that stores, for each user identity, a limiting condition for limiting use of the image forming apparatus, and a limiting-condition sending unit that receives the user identity sent from the image forming apparatus and sends the limiting condition stored in association with the received user identity to the image forming apparatus. The image forming apparatus further includes a determining unit that determines whether the communication unit has received the limiting condition, and a display unit that displays, in response to the determining unit determining that the communication unit has received the limiting condition, limit information indicating details about limitation corresponding to the limiting condition determined to be received. The storage unit is capable of storing, for each user identity, a plurality of limiting conditions.

A server computer according to a third aspect of the present disclosure is capable of limiting use of an image forming apparatus by a user who has passed user authentication. The server computer includes a receiving unit that receives a user identity from the image forming apparatus; a storage unit that stores, for each user identity, a limiting condition for limiting use of the image forming apparatus; a determining unit that determines whether the storage unit stores a limiting condition in association with the user identity received from the image forming apparatus; and a sending unit that sends, to the image forming apparatus, in response to the determining unit determining that the storage unit stores the limiting condition in association with the user identity, limit information indicating details about limitation corresponding to the limiting condition determined to be stored in the storage unit. The storage unit is capable of storing, for each user identity, a plurality of limiting conditions.

A terminal apparatus according to a fourth aspect of the present disclosure gives a print instruction to an image forming apparatus having a print function for which a plurality of limitations are settable for each user. The terminal apparatus includes an input unit that accepts input of an instruction from a user; a display unit that displays a print setup window in response to the input unit accepting a print instruction from the user; a sending unit that sends, in response to the input unit accepting the print instruction from the user, a user identity of the user and a print setting to the image forming apparatus; and a receiving unit that receives, from the image forming apparatus, limit information indicating details about limitation of the print function set in association with the user identity sent by the sending unit. The display unit displays the limit information received by the receiving unit in the print setup window.

A display method according to a fifth aspect of the present disclosure is a method for displaying limit information indicating details about limitation in an image forming apparatus capable of limiting use of the image forming apparatus by a user who has passed user authentication. The display method includes performing user authentication; setting, for each user, a limiting condition for limiting use of the image forming apparatus; accepting input of an instruction from the user; determining, in response to acceptance of the instruction from the user, whether the limiting condition is set for the user; and displaying, in response to the limiting condition being determined to be set for the user, the limit information indicating details about limitation corresponding to the limiting condition determined to be set for the user. A plurality of limiting conditions are settable for each user.

DESCRIPTION OF THE EMBODIMENTS

Figure 1:
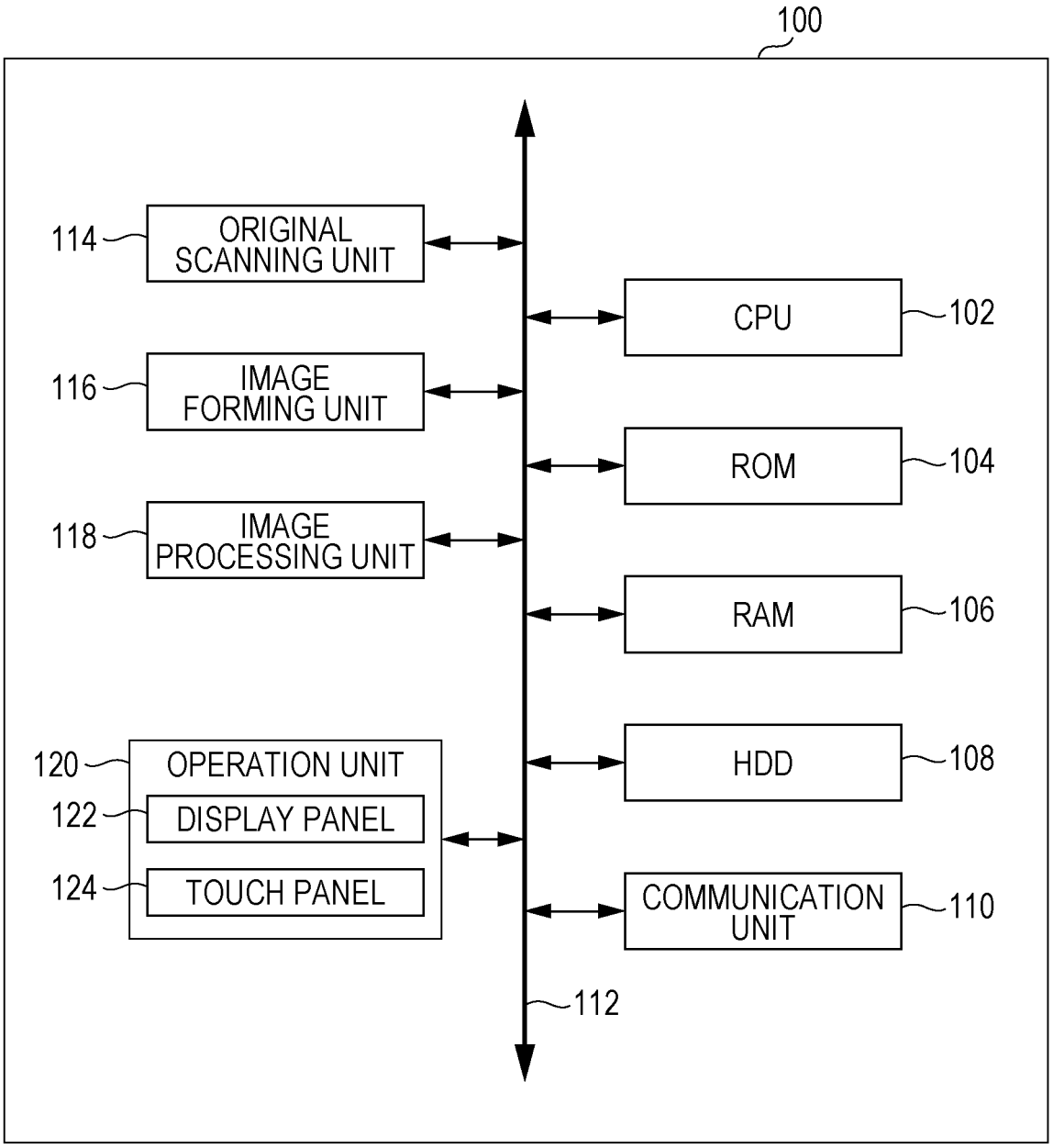
FIG. 1 is a block diagram illustrating an internal configuration of an image forming apparatus according to a first embodiment of the present disclosure.

In embodiments below, the same or substantially the same components are denoted by the same reference numerals. Such components have the same names and have the same or substantially the same functions. Accordingly, a detailed description of such components is not repeated.

First Embodiment

An image forming apparatus 100 according to a first embodiment is, for example, a multifunctional peripheral (MFP) having functions, such as a copy function and a print function. Referring to FIG. 1, the image forming apparatus 100 includes a central processing unit (CPU) 102, a read only memory (ROM) 104, a random access memory (RAM) 106, and a hard disk drive (HDD) 108. The CPU 102 controls the entirety of the image forming apparatus 100. The ROM 104 stores a program and so on. The RAM 106 is a volatile storage device. The HDD 108 is a nonvolatile storage device that keeps holding data while power supply is stopped. The ROM 104 stores a program and data used to control operation of the image forming apparatus 100.

The image forming apparatus 100 further includes a communication unit 110, an original scanning unit 114, an image forming unit 116, an image processing unit 118, an operation unit 120, and a bus 112. The image forming apparatus 100 also includes a feeding unit, a recording-medium transporting unit, and a discharge tray (which are not illustrated in FIG. 1).

The CPU 102, the ROM 104, the RAM 106, the HDD 108, the communication unit 110, the original scanning unit 114, the image forming unit 116, the image processing unit 118, and the operation unit 120 are connected to the bus 112 and exchange data (including control information) via the bus 112. For example, the CPU 102 loads a program from the ROM 104 into the RAM 106 via the bus 112 and executes the program by using a part of the RAM 106 as a workspace. That is, the CPU 102 controls the components of the image forming apparatus 100 in accordance with a program stored in the ROM 104 and implements functions of the image forming apparatus 100.

The original scanning unit 114 scans an original and generates image data by using a charge coupled device (CCD) sensor, for example. The image data is temporarily stored in the RAM 106.

The image processing unit 118 performs various types of image processing on the image data generated by the original scanning unit 114 and generates print image data. The print image data is stored in the RAM 106. Based on the print image data stored in the RAM 106, the image forming unit 116 forms (prints) an image on a recording medium transported by the recording-medium transporting unit from the feeding unit.

The operation unit 120 includes, for example, a touch-screen. Specifically, the operation unit 120 includes a display panel 122 such as a liquid crystal panel and a touch panel 124 which is placed on the display panel 122 and detects a touched position. The display panel 122 displays a window for inputting an instruction to the image forming apparatus 100. The user touches the touch panel 124 placed on the display panel 122 at a position corresponding to a position of a key displayed on the display panel 122. In this way, the user can set function settings and input an operation instruction to the image forming apparatus 100. For example, in response to a user instruction to copy an original, the original placed at the original scanning unit 114 is scanned and image data is generated. Based on the image data, an image is formed on a recording medium transported from the feeding unit. The recording medium having the image formed thereon is discharged to the discharge tray.

Figure 2:
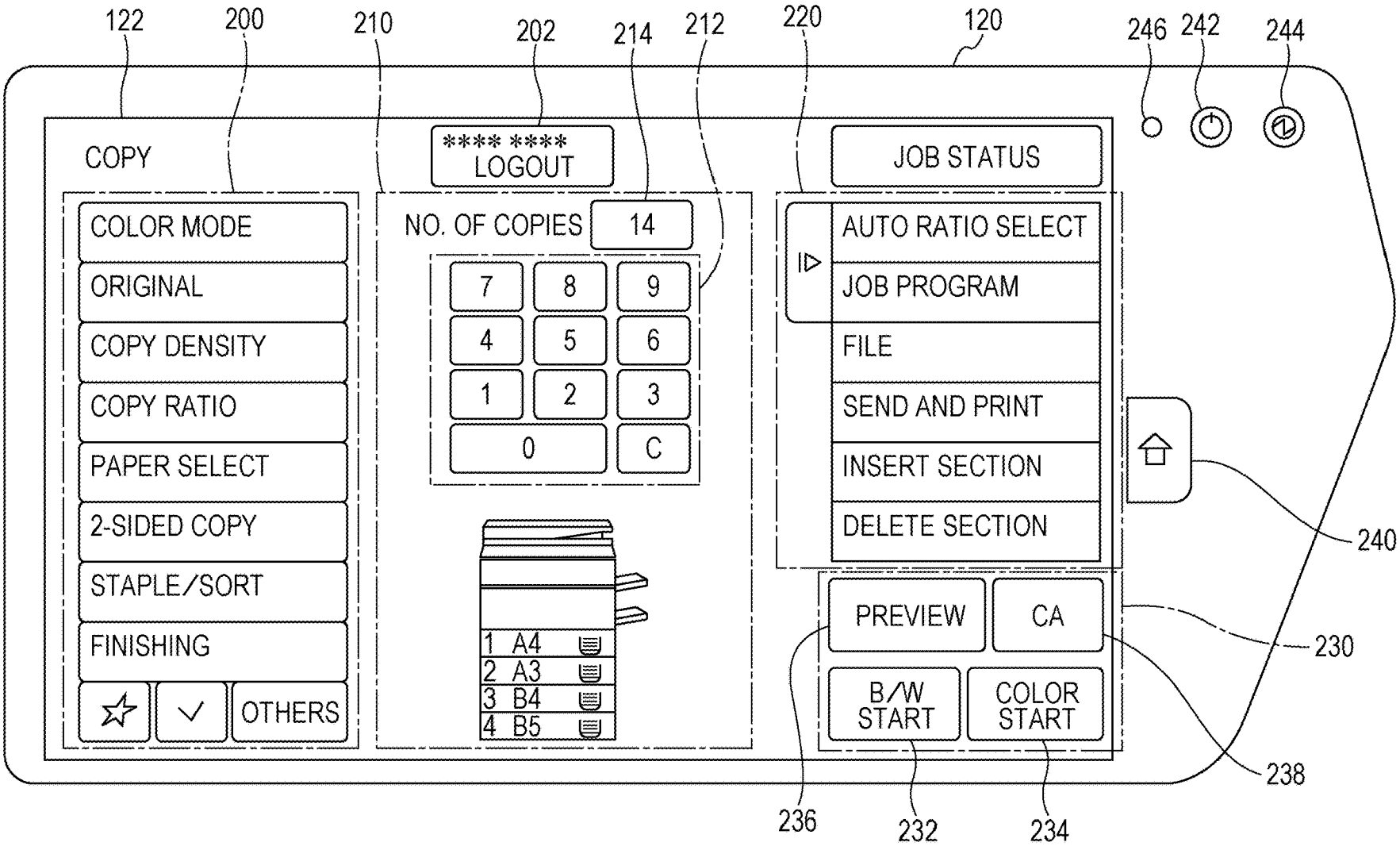
FIG. 2 is a plan view illustrating an operation unit of the image forming apparatus illustrated in FIG. 1.

Referring now to FIG. 2, the operation unit 120 includes a plurality of hardware keys (such as a home key 240, a power key 242, and a power-saving key 244) and a power light-emitting diode (LED) 246 at its right portion. The power key 242 is a key used to power on and off the image forming apparatus 100. The power-saving key 244 is a key used to set the image forming apparatus 100 into the power-saving mode. The power LED 246 turns on while the image forming apparatus 100 is in a power-on state. The home key 240 is a key used to display a home window (e.g., a window having icons for respective modes to be selected) on the display panel 122.

At the topmost portion of the operation window displayed on the display panel 122, the current mode (Copy) and a key 202 for logout are displayed. The key 202 displays a user name of the currently logged-in user. An area under the topmost portion is divided into a function setup area 200, a preview area 210, an action panel area 220, and a task triggering area 230.

The function setup area 200 includes a plurality of keys (hereinafter, also referred to as function setup keys) used to set settings regarding functions of the current mode of the image forming apparatus 100. The function setup area 200 illustrated in FIG. 2 displays some function setup keys, and other function setup keys that are not displayed are displayed if a key "OTHERS" is touched. The preview area 210 includes a numeral key area 212 and a number-of-copies display area 214. The number of copies is input with numeral keys arranged at the numeral key area 212.

The action panel area 220 displays information such as a help, an advice, and a suggestion regarding an operation. For example, when a user selects a certain function, the action panel area 220 displays sub-functions related to the selected function.

The task triggering area 230 is an area displaying keys that serve as triggers to cause the image forming apparatus 100 to start processing. Specifically, the task triggering area 230 displays a black-and-white start key 232, a color start key 234, a preview key 236, and a reset key 238. The black-and-white start key 232 is used to start black-and-white copying. The color start key 234 is used to start color copying. The preview key 236 is used to start a process for scanning an original to be copied and displaying a preview. The reset key 238 is used to clear all settings.

The communication unit 110 is an interface that is connected to a network and that allows the image forming apparatus 100 to communicate with an external apparatus via the network. The communication unit 110 is, for example, a network interface card (NIC). The communication unit 110 allows the image forming apparatus 100 to receive a print job from an external apparatus, and the image forming apparatus 100 forms an image on a recording medium in accordance with the print job.

The image forming apparatus 100 may include a modem and may be connected to a telephone line via the modem. If the image forming apparatus 100 is connected to a telephone line, such a configuration allows a user to fax image data obtained by scanning an original via the telephone line.

Figure 3:
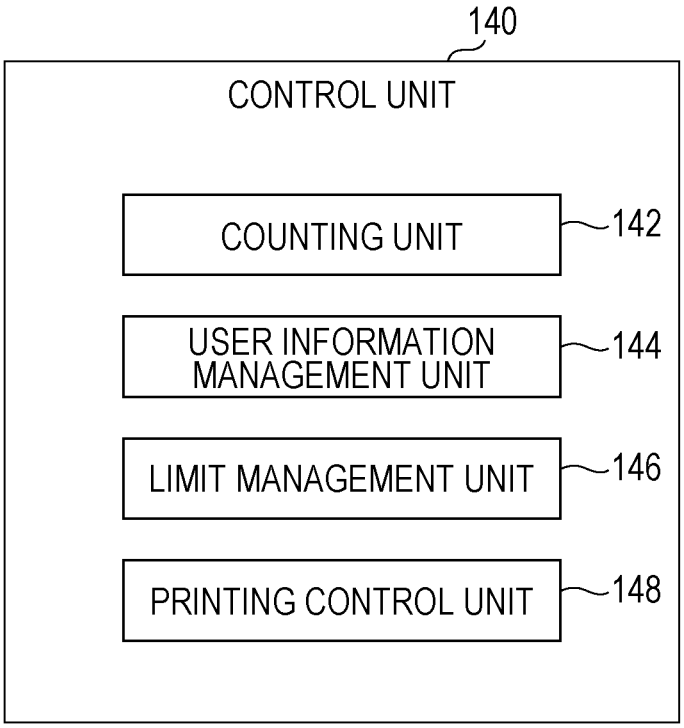
FIG. 3 is a block diagram illustrating functional units of a control unit of the image forming apparatus illustrated in FIG. 1.

The CPU 102, the ROM 104, the RAM 106, and the HDD 108 function as a control unit 140 illustrated in FIG. 3. The control unit 140 includes a counting unit 142, a user information management unit 144, a limit management unit 146, and a printing control unit 148.

The image forming apparatus 100 has a login authentication function. A user who has passed authentication is permitted to operate the image forming apparatus 100. The user information management unit 144 manages (for example, stores, modifies, and deletes) information concerning users, such as the user ID and the password which are used in user authentication.

The image forming apparatus 100 has a function for limiting the use of the image forming apparatus 100 depending on the user. The limit management unit 146 manages information that specifies limitations set for each user. For example, information that specifies a limited function (hereinafter, referred to as limited function specifying information) and information that specifies a parameter indicating a degree of limitation (hereinafter, referred to as a limit parameter) are managed in association with the user ID. It is assumed that one or more sets of the limited function specifying information and the limit parameter are stored in association with a user ID, for example. Hereinafter, a set of the limited function specifying information and the limit parameter is referred to as a limiting condition.

For example, as for a user who is prohibited from performing color copying, the limited function specifying information indicating color copying and "0" are stored in association with the user ID of the user. In this case, the limit parameter is unnecessary; however, it is assumed that "0" is stored as an invalid limit parameter for convenience. As for a user for whom the number of sheets permitted in color copying is limited, the limited function specifying information indicating color copying and a limit on the number of sheets permitted (i.e., the limit parameter) which is the upper limit on the number of sheets permitted are stored in association with the user ID of the user.

The counting unit 142 counts the number of recording media used in printing performed by the user so as to calculate the total number of recording media that have been used and stores the total number of recording media that have been used, in order to limit the number of sheets permitted on a user-by-user basis.

The printing control unit 148 controls the original scanning unit 114, the image forming unit 116, and the image processing unit 118 and forms an image on a recording medium, as described above.

Figure 4:
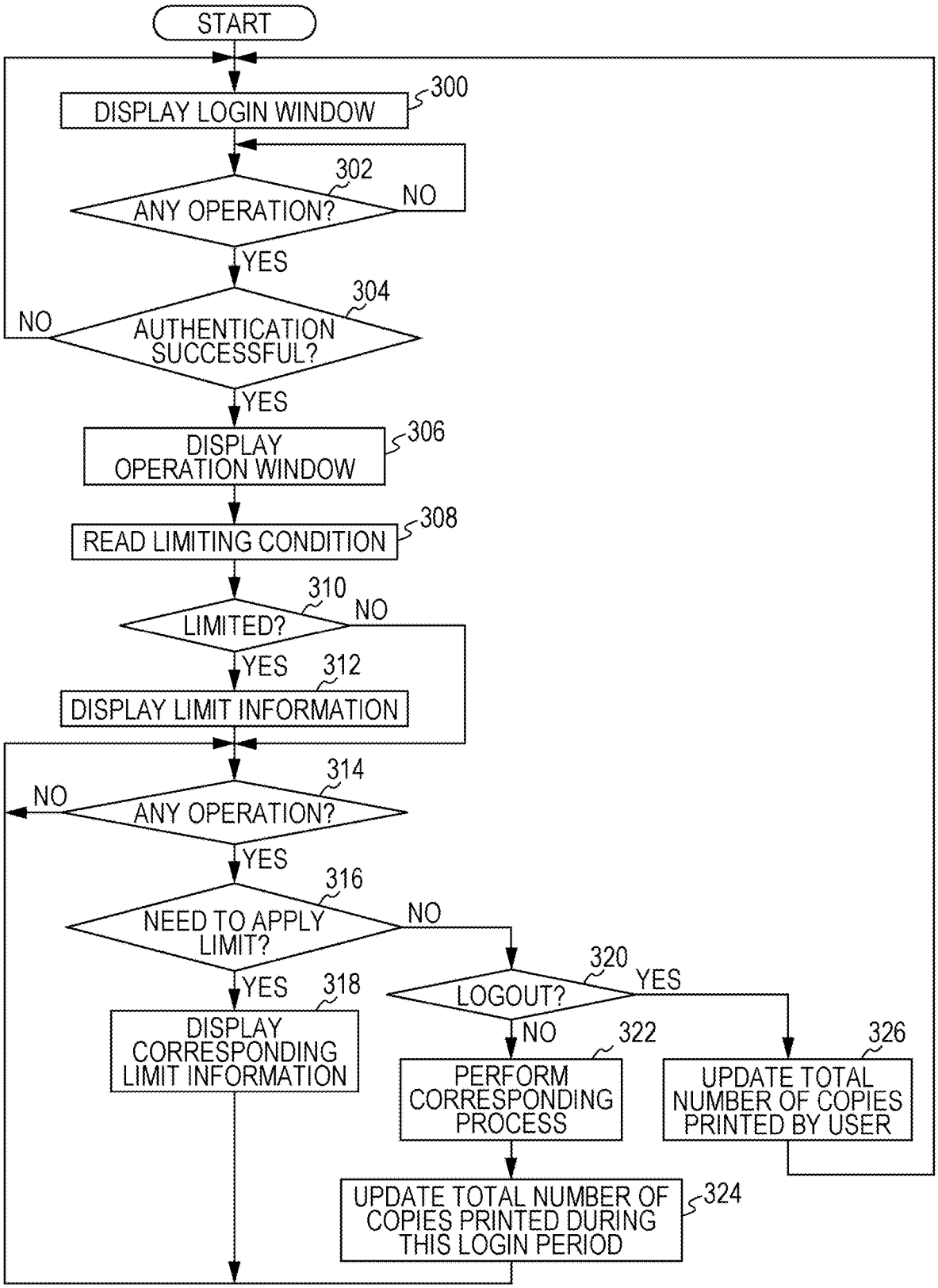
FIG. 4 is a flowchart illustrating a control flow of a program for displaying information indicating limitation on the use of the image forming apparatus by a user, the program being executed by the image forming apparatus illustrated in FIG. 1.

Referring now to FIG. 4, a control flow of a program for displaying information indicating limitation on the use of the image forming apparatus by the user in the image forming apparatus 100 will be described. It is assumed that a basic window of the copy mode is set as a home window, and the window illustrated in FIG. 2 is displayed after successful login authentication.

The program is started when the power key 242 of the image forming apparatus 100 is switched on. In step 300, the CPU 102 displays a login window for performing user authentication on the operation unit 120. Specifically, the CPU 102 reads image data of the login window pre-stored in the HDD 108 or the like and displays the login window based on the image data on the display panel 122. The login window includes fields for inputting the user ID and the password, for example.

In step 302, the CPU 102 determines whether a user has input data used in authentication by performing an operation on the login window. Specifically, upon the field for inputting the user ID or the password of the login window being touched, the CPU 102 displays numeral keys and alphabet keys and waits for the user ID or the password to be input. Upon the user ID and the password being input, the control process proceeds to step 304; otherwise, step 302 is repeated.

In step 304, the CPU 102 performs login authentication and determines whether the user has passed the authentication. Specifically, the CPU 102 searches a database (of sets of the user ID and the password) pre-stored in the HDD 108 for the user ID input in step 302, reads the password associated with the user ID from the HDD 108, and determines whether the read password matches the input password. If the passwords match, the CPU 102 determines that the user has passed the authentication, and the control process proceeds to step 306. If the passwords do not match, the control process returns to step 300.

Figure 5:
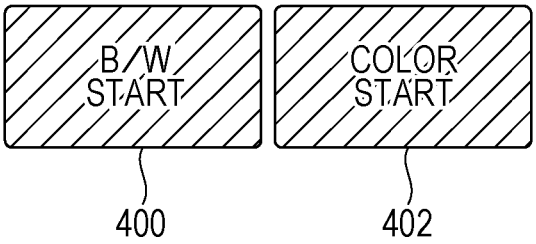
FIG. 5 is a diagram illustrating start keys displayed in an operation window when the image forming apparatus is not ready to operate.

In step 306, the CPU 102 displays the basic window of the copy mode. For example, the window illustrated in FIG. 2 is displayed. The start keys (the black-and-white start key 232 and the color start key 234) are displayed initially in a manner as illustrated in FIG. 5 in the task triggering area 230 of the operation window. A black-and-white start key 400 and a color start key 402 illustrated in FIG. 5 indicate that the CPU 102 is reading the default settings of the copy mode and is not yet ready to perform copying in response to pressing of the key (hatching indicates grayed-out display).

Figure 6:
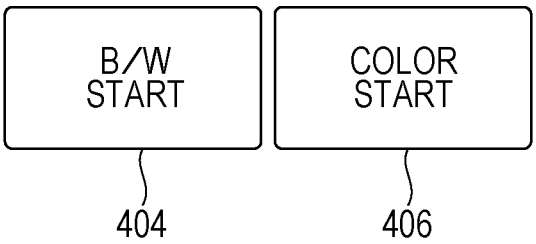
FIG. 6 is a diagram illustrating the start keys displayed in the operation window when the image forming apparatus is ready to operate.

Upon the CPU 102 completing reading the default settings of the copy mode and becoming ready to perform copying in response to pressing of the key, the start keys illustrated in FIG. 5 are changed to a black-and-white start key 404 and a color start key 406 illustrated in FIG. 6.

In step 308, the CPU 102 reads, from the HDD 108, a limiting condition associated with the user ID of the user who is determined to have passed the authentication in step 304.

In step 310, the CPU 102 determines whether a limitation is set for the user who is determined to have passed the authentication in step 304. Specifically, the CPU 102 determines whether the limiting condition is successfully read in step 308. If the limiting condition is successfully read, the CPU 102 further determines whether the limiting condition includes a valid limit parameter and determines whether a value of the limit parameter has been reached based on a use history of the image forming apparatus 100 by the user.

If the limit parameter of the read limiting condition has an invalid value (e.g., "0"), that is, if the limited function specifying information alone is valid, the CPU 102 determines that a limitation is set for the user, and the control process proceeds to step 312. If the read limiting condition includes a valid limit parameter and the value of the limit parameter has been reached, the control process also proceeds to step 312. Otherwise, that is, if no limiting condition is stored in association with the user and the CPU 102 has failed to read the limiting condition (including the case where the user ID is not stored) or if the read limiting condition includes a valid limit parameter but the value of the limit parameter has not been reached, the control process proceeds to step 314.

For example, if color copying is set as the limited function specifying information and the limit parameter has an invalid value in the limiting condition, the control process proceeds to step 312. Suppose that color copying is set as the limited function specifying information and the limit on the number of sheets permitted is set to 100 as the limit parameter. In such a case, the control process proceeds to step 312 if the value of the limit parameter has been reached (for example, if 100 sheets have already been used in color copying), whereas the control process proceeds to step 314 if the value of the limit parameter has not been reached (for example, the number of sheets that have been used in color copying is less than 100).

In step 312, the CPU 102 displays limit information corresponding to the limiting condition read in step 308, in the operation window displayed in step 306. Specifically, the CPU 102 displays information (e.g., text information) indicating that the function is prohibited over a component (e.g., key) corresponding to the limited function specifying information read in step 308 on the operation window.

Figure 7:
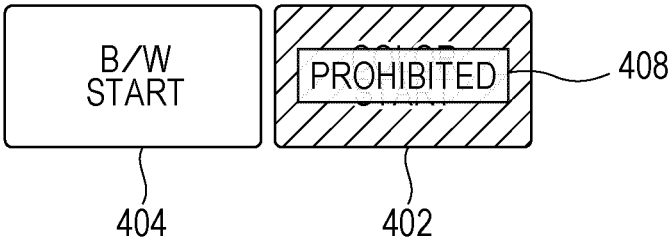
FIG. 7 is a diagram illustrating the state in which limit information is displayed over the start key in the operation window in the case where the user is prohibited from performing color copying.

If color copying is set as the limited function specifying information and no limit parameter is set in the limiting condition, limit information 408 is displayed over the color start key 402 as illustrated in FIG. 7. In this case, the limit information 408 is text information "PROHIBITED". At this time, the color start key 402 is grayed out. In addition, the limit information 408 is displayed translucently so as to allow the user to know the color start key 402 is below the limit information 408. As described above, the black-and-white start key 404 is displayed in a state which indicates that the CPU 102 is ready to perform processing in response to pressing of the key.

Figure 8:
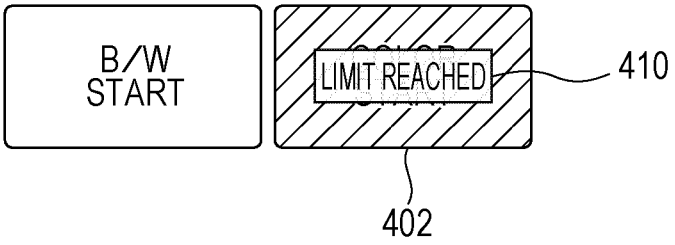
FIG. 8 is a diagram illustrating the state in which limit information is displayed over the start key in the operation window in the case where the number of sheets permitted for the user in color copying is limited and the limit has been reached.

For example, if color copying is set as the limited function specifying information, 100 which indicates a limit on the number of sheets permitted is set as the limit parameter, and the value of the limit parameter has been reached (for example, 100 sheets have already been used in color copying), limit information 410 is displayed in a manner illustrated in FIG. 8. As in FIG. 7, the limit information 410 is displayed over the color start key 402 translucently in FIG. 8. Note that the limit information 410 is displayed in order to inform the user that color copying is not prohibited but the limit on the number of sheets permitted has been reached. In this case, the limit information 410 is the text information "LIMIT REACHED".

Figure 9:
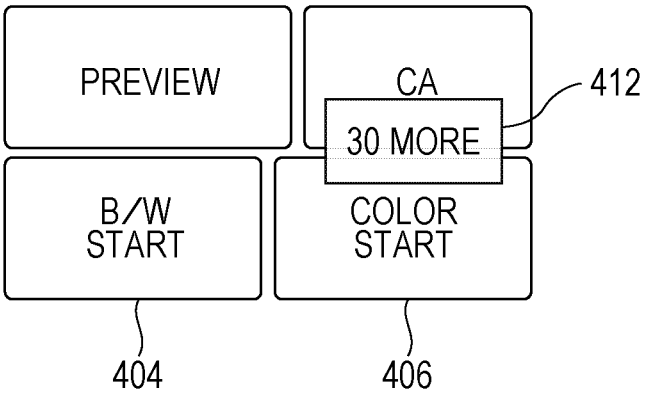
FIG. 9 is a diagram illustrating the state in which limit information is displayed over the start key in the operation window in the case where the number of sheets permitted for the user in color copying is limited and the limit has not been reached.

For example, if color copying is set as the limited function specifying information and 100 which indicates a limit on the number of sheets permitted is set as the limit parameter but the value of the limit parameter has not been reached (for example, the number of sheets that have already been used in color copying is less than 100 (is 70, for example)), limit information 412 is displayed so as to be partially superimposed with the color start key 406 corresponding to the limited function specifying information, as illustrated in FIG. 9. The limit information 412 "30 MORE" indicates that 30 more sheets are permitted for the user. At this time, the color start key 406 and the black-and-white start key 404 are displayed in a state which indicates that the CPU 102 is ready to perform processing in response to pressing of the key as described above.

In step 314, the CPU 102 determines whether the user has performed an operation on the operation window. Specifically, the CPU 102 determines whether a key displayed in the operation window (see FIG. 2) has been operated. If it is determined that a key has been operated, the control process proceeds to step 316; otherwise, step 314 is repeated.

In step S316, the CPU 102 determines whether to apply a limitation in accordance with the operation detected in step 314. For example, if no limitation is set for the logged-in user, there is no need to apply any limitation. Thus, the control process proceeds to step 320. In addition, when the start keys are displayed in the manner of FIG. 7 or 8, the color start key 402 is not selectable. Accordingly, in response to operation of a selectable key, the control process proceeds to step 320.

If the user touches the color start key 406 after setting the number of copies to 31 or more in the state where the task triggering area 230 is displayed in a manner of FIG. 9, the total number of sheets used will exceed the limit if the job is executed. Accordingly, the CPU 102 determines to apply a limitation, and the control process proceeds to step 318.

In step 318, the CPU 102 displays limit information over the corresponding key. Then, the control process returns to step 314.

Figure 10:
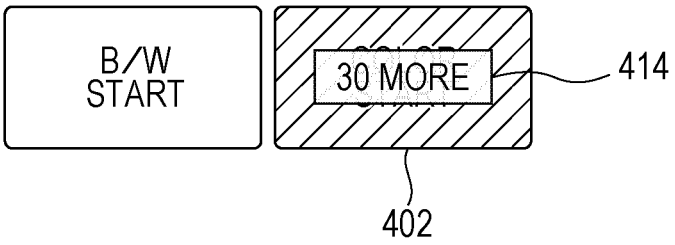
FIG. 10 is a diagram illustrating the state in which limit information is displayed over the start key in the operation window in the case where the number of sheets permitted for the user in color copying is limited and the limit will be reached if a color copying job is executed.

For example, if the user touches the color start key 406 after setting the number of copies to 31 or more in the state where the task triggering area 230 is displayed in a manner of FIG. 9, the number of remaining sheets permitted (30 sheets) is displayed as limit information 414 over the color start key 402 as illustrated in FIG. 10. At this time, the color start key 402 is grayed out (in a not-selectable state). In addition, the limit information 414 is displayed translucently so as to allow the user to know the color start key 402 is below the limit information 414.

If the original scanning unit 114 includes an automatic document feeder and originals are placed at the automatic document feeder, the CPU 102 is capable of calculating the number of sheets to be used in the job before executing the job. Accordingly, if it is expected that the total number exceeds the limit, the limit information may be displayed in a manner as illustrated in FIG. 10. Specifically, the CPU 102 is capable of counting originals by transporting the originals placed at the automatic document feeder in response to touching of the color start key 234 and determining whether the total number will exceed the limit if the job is executed, taking into account the obtained number of originals and the copy settings. At this time, a configuration for scanning the originals as in the case where the preview key 236 is touched allows the user to perform printing without placing the originals at the automatic document feeder again if the total number does not exceed the limit.

If it is determined in step 316 that there is no need to apply any limitation, the CPU 102 determines whether a logout instruction is input in step 320. Specifically, it is determined that a logout instruction is input if the key 202 is operated, and the control process proceeds to step 326; otherwise, the control process proceeds to step 322.

In step 322, the CPU 102 performs a process corresponding to the operation detected in step 314. Specifically, the CPU 102 performs a process corresponding to the key touched on the operation window. For example, if an operation of the black-and-white start key 232 or the color start key 234 has been detected in step 314, the CPU 102 starts a printing program and executes the corresponding job.

If a copy job is executed in step 322, the CPU 102 updates the total number of sheets printed during this login period by using the number of sheets used in the job in step 324. If the total number of sheets printed is not stored in the RAM 106, the CPU 102 stores the number of sheets used in the job as the initial value for the total number of sheets in the RAM 106. For example, in the case where the color start key 234 is operated in step 314 and the job is executed, the CPU 102 calculates the number of sheets used in the job from the settings of the job and adds the calculated number of sheets to the total number of sheets that have been used in color copying since the login to the present time point and that is stored in the RAM 106. In the case where the black-and-white start key 232 is operated, the total number of sheets used in black-and-white copying, which is stored in the RAM 106, is also updated. The control process then returns to step 314.

If it is determined in step 320 that a logout instruction has been input, the CPU 102 updates the total number of printed sheets stored in the HDD 108 in step 326. Specifically, the CPU 102 adds the total number of printed sheets that has been updated in step 324 during this login period and that is stored in the RAM 106, to the total number of sheets that have been used by the user and that is stored in the HDD 108 and deletes the total number of sheets stored in the RAM 106. The control process then returns to step 300.

How limit information is displayed by the program of FIG. 4 in the case where the image forming apparatus 100 is capable of limiting black-and-white copying and color copying for each user and where limitations are set for users A to C as illustrated in Table 1 will be described.

TABLE 1

| | Function to be limited | |
|---|---|---|
| User name | Black-and-white copying | Color copying |
| User A | — | Prohibited |
| User B | — | 100 |
| User C | Prohibited | Prohibited |

Referring to Table 1, "Black-and-white copying" and "Color copying" are functions specified by the limited function specifying information, and "100" is the limit parameter. "Prohibited" and "-" respectively indicate that the user is prohibited from using the function specified by the corresponding limited function specifying information and that the user is permitted to use the function specified by the corresponding limited function specifying information. The value "100" indicates the limit set for the function specified by the corresponding limited function specifying information, that is, the limit on the number of sheets permitted in color copying. The HDD 108 stores the limiting conditions, that is, sets of the limited function specifying information and the limit parameter in association with the user ID of each user. As the limiting condition, data is stored for cells other than cells with "-" (no limitation is applied for cells with "-"). The limit parameter is unnecessary for cells with "Prohibited", and thus an invalid limit parameter (e.g., "0") is stored for these cells. For example, {the user ID of the user A, Color copying, 0} is stored for the user A, {the user ID of the user B, Color copying, 100} is stored for the user B, and {the user ID of the user C, Black-and-white copying, 0, Color copying, 0} is stored for the user C.

If the user A passes login authentication, the start keys are displayed in a manner as illustrated in FIG. 7 in the operation window displayed in steps 306 to 312, and the limit information 408 is displayed over the color start key 234 (color copying is prohibited).

If the user B passes login authentication, the start keys are displayed in a manner as illustrated in FIG. 8 or 9 depending on the current total number of sheets used by the user B, in the operation window displayed in steps 306 to 312 (the number of sheets permitted in color copying is limited). If the current total number of sheets used by the user B is 100, the start keys are displayed in a manner as illustrated in FIG. 8; if the current total number of sheets is less than 100, the number of remaining sheets permitted is displayed in a manner as illustrated in FIG. 9. In the case where the start keys are displayed in a manner as illustrated in FIG. 9, if the user B sets a job that causes the total number of sheets used in color copying to exceed the limit (YES in step 316), the limit information is displayed in a manner as illustrated in FIG. 10 (step 318).

Figure 11:
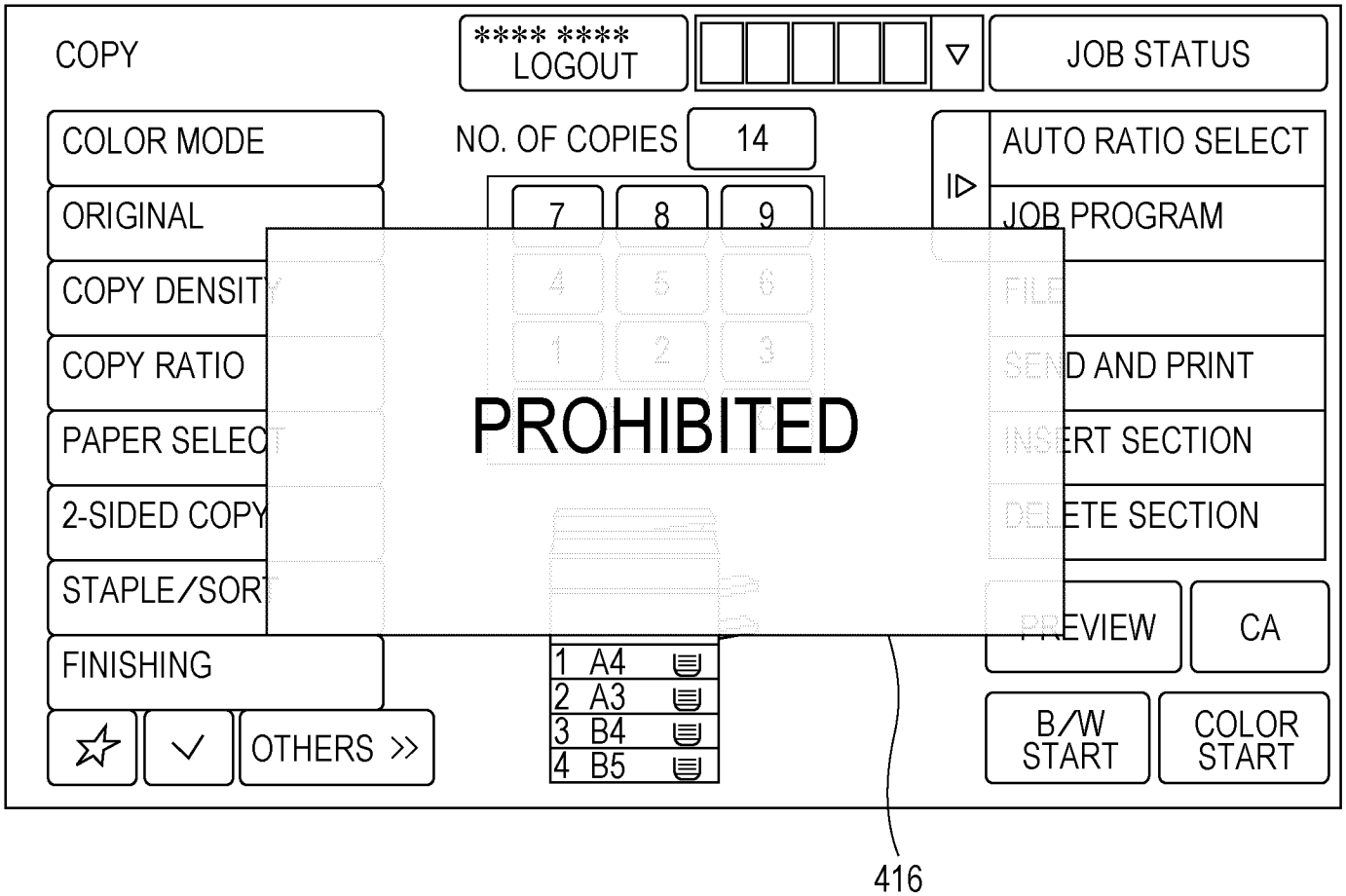
FIG. 11 is a diagram illustrating the state in which limit information is displayed in the operation window in the case where the user is prohibited from performing copying.

If the user C passes login authentication, the operation window is displayed in a manner as illustrated in FIG. 11 in steps 306 and 312. For the user C, the black-and-white start key may be grayed out and the limit information 408 may be displayed over the grayed-out black-and-white start key like the color start key 402 of FIG. 7; however, the user C is prohibited from performing black-and-white copying and color copying and thus is not permitted to use the copy function. Accordingly, if the user C is permitted to operate function setup keys in the function setup area 200, such a configuration is pointless. Thus, limit information 416 is displayed translucently over the entire operation window as illustrated in FIG. 11.

If a user other than the users A, B, and C passes login authentication, the operation window not including the limit information is displayed as a result of steps 306 to 312.

As described above, if a setting for limiting the use of the image forming apparatus 100 is set for a logged-in user, the image forming apparatus 100 is capable of displaying limit information so that the user can understand details about the limitation. Because the user can understand details about the limitation upon seeing the displayed limit information, the user can change the setting to avoid the limitation. For example, in the case where color copying is prohibited or the number of sheets permitted in color copying has reached the limit, the user can change the setting from color copying to black-and-white copying and perform black-and-white copying. In addition, in the case where the total number of sheets used by the user will exceed the limit if the set job is executed, the user can avoid the limitation by changing the setting to N-in-1 copying (such as 2-in-1 or 4-in-1 copying). In addition, in the case where user is permitted to submit a request to change the limitation to the administrator, the user can submit such a request by specifically indicating how the limitation is to be changed.

The program described with reference to FIG. 4 may be executed in various modified manners. For example, the case of reading the limiting condition (step 308) after displaying a normal operation window (step 306) and of displaying limit information if there is any limitation (step 312) has been described above; however, the order of steps is not limited to this particular order. The limiting condition may be read before the normal operation window is displayed. Such a configuration allows an operation window including the limit information to be displayed from the beginning if a limitation is set for the user.

In addition, the case of displaying the basic window of the copy mode after the user has logged in has been described above; however, the window displayed is not limited to this particular window. A home window that allows the user to select a mode which the user wishes to use from among a plurality of operation modes may be displayed immediately after the login. In such a case, the limit information may be displayed in accordance with the limiting condition set for the user when the basic window of the copy mode is displayed upon the user selecting the copy mode.

The case of displaying text information as the limit information has been described above; however, the limit information is not limited to this particular information. For example, the limit information may be a figure (such as "x") indicating prohibition or information based on a combination of text and a figure.

Figure 12:
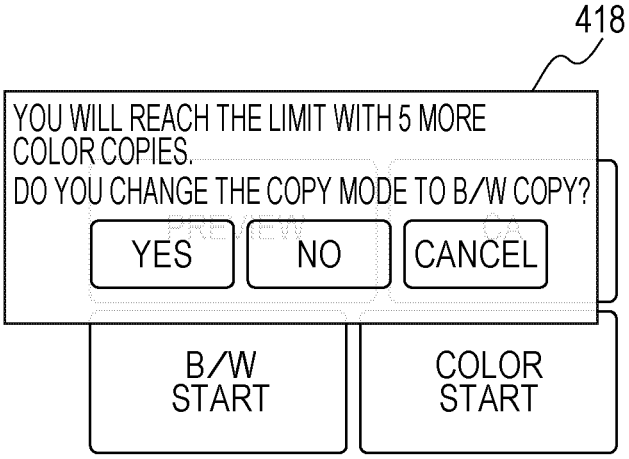
FIG. 12 is a diagram illustrating limit information displayed in the case where the number of sheets permitted for the user in color copying is limited and the limit will be reached if a color copying job is executed.

The case of displaying a value up to the limit (remaining value) alone as illustrated in FIG. 9 if the total number does not exceed the limit when a value (limit) is set as the limit parameter has been described above; however, the displayed information is not limited to this particular information. For example, limit information 418 including the remaining value, information helping the user avoid the limitation, and keys for selecting options may be displayed as illustrated in FIG. 12. If a yes key is selected in FIG. 12, the setting is changed from color copying to black-and-white copying. If a no key is selected, the setting of color copying is not changed. For example, the user is not permitted to perform color copying if the number of copies is set to 6 or greater. Accordingly, the user may perform color copying by changing the number of copies to 5 or less. If a cancel key is selected, the copy settings are cleared. If the user wishes to perform color copying to produce 6 or more copies, the user may submit a request to change the limit of color copying to the administrator.

Second Embodiment

The image forming apparatus 100 performs login authentication of a user in the first embodiment, whereas a server computer performs login authentication in a second embodiment.

Figure 13:
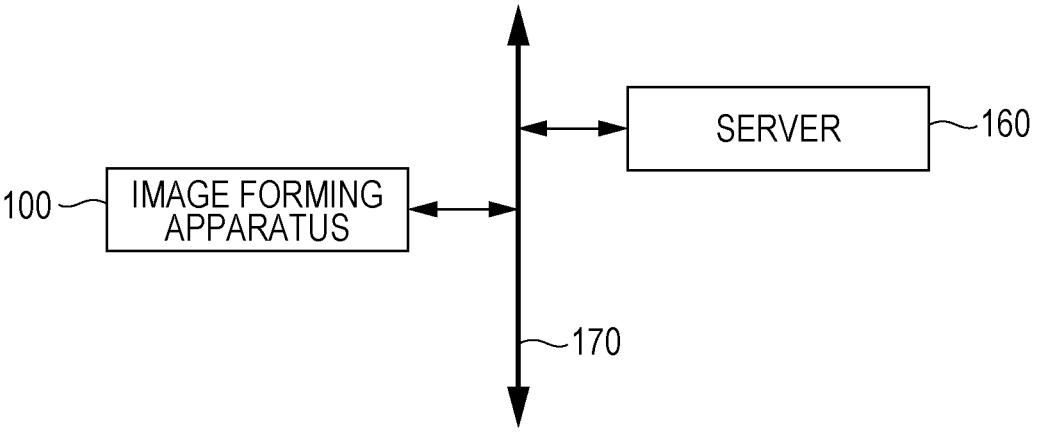
FIG. 13 is a block diagram illustrating a configuration of an image forming system according to a second embodiment of the present disclosure.

Referring to FIG. 13, an image forming system according to the second embodiment includes the image forming apparatus 100 configured in a manner as illustrated in FIG. 1, a server computer (hereinafter, simply referred to as a server) 160, and a network 170 to which the image forming apparatus 100 and the server 160 are connected. The image forming apparatus 100 is connected to the network 170 via the communication unit 110 (see FIG. 1). The operation window illustrated in FIG. 2 is displayed on the operation unit 120 of the image forming apparatus 100 according to the second embodiment.

In the second embodiment, login authentication is performed before the user uses the image forming apparatus 100 as in the first embodiment; however, the second embodiment differs from the first embodiment in that the server 160 performs login authentication. The second embodiment also differs from the first embodiment in that the server 160 stores and manages the limiting condition set for each user. That is, the image forming apparatus 100 does not include functions corresponding to the user information management unit 144 and the limit management unit 146 among the functional units illustrated in FIG. 3.

Figure 14:
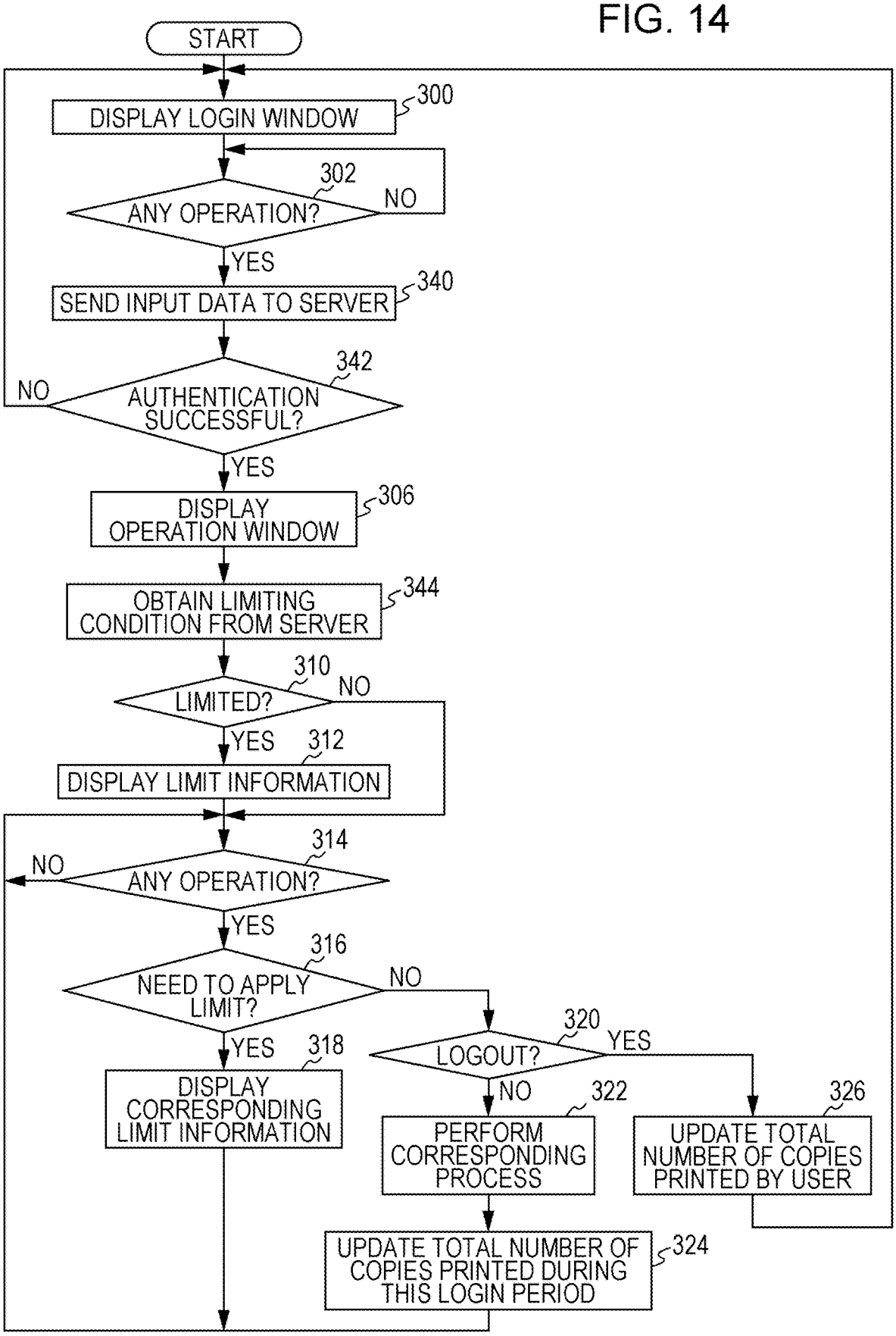
FIG. 14 is a flowchart illustrating a control flow of a program for displaying information indicating limitation, the program being executed by an image forming apparatus illustrated in FIG. 13.

The image forming apparatus 100 according to the second embodiment executes a program described in FIG. 14. The program described in FIG. 14 differs from the program described in FIG. 4 in that step 340 is added and steps 304 and 308 of FIG. 4 are respectively replaced by steps 342 and 344. In FIG. 14, steps denoted by the same reference numerals as those of FIG. 4 are the same as steps described in FIG. 4.

The program described in FIG. 14 is started when the power key 242 of the image forming apparatus 100 is switched on. In step 300, the CPU 102 displays a login window on the operation unit 120. If the CPU 102 determines in step 302 that data has been input, the CPU 102 sends the user ID and the password input in step 302 to the server 160 along with information (request command) indicating a request for login authentication in step 340 and waits for an authentication result from the server 160.

Upon receipt of the login authentication request command, the server 160 searches a database (of sets of the user ID and the password) pre-stored therein for the received user ID and reads the password associated with the user ID. The server 160 then determines whether the read password matches the received password and sends the result (authentication result) to the image forming apparatus 100. Specifically, the server 160 sends information indicating successful user authentication if the passwords match and sends information indicating unsuccessful user authentication if the passwords do not match.

In step 342, the CPU 102 determines whether information indicating successful authentication has been received. If the information indicating successful authentication has been received, the control process proceeds to step 306; otherwise (if information indicating unsuccessful authentication has been received), the control process returns to step 300.

After the basic window of the copy mode (see FIG. 2) has been displayed in step 306, the CPU 102 sends the user ID and a limiting condition request command to the server 160 so as to obtain the limiting condition associated with the user ID from the server 160 in step 344.

Upon receipt of the limiting condition request command, the server 160 searches a database (in which each user ID is associated with a limiting condition) pre-stored therein, for the received user ID and identifies the corresponding limiting condition. The server 160 sends the identified limiting condition to the image forming apparatus 100. If no limiting condition is found in association with the received user ID, the server 160 sends information indicating no corresponding limiting condition.

Thereafter, the CPU 102 performs determination in step 310 in accordance with the information received from the server 160. The CPU 102 performs step 312 in accordance with the result of the determination, and then performs steps 314 to 326.

As described above, if a setting for limiting the use of the image forming apparatus 100 is set for a logged-in user, the image forming apparatus 100 is capable of displaying limit information so that the user can understand details about the limitation as in the first embodiment. Because the user can understand details of the limitation upon seeing the displayed limit information, the user can change the setting to avoid the limitation. In addition, in the case where user is permitted to submit a request to change the limitation to the administrator, the user can submit such a request by specifically indicating how the limitation is to be changed.

The program described with reference to FIG. 14 may be executed in various modified manners. For example, the case of obtaining the limiting condition from the server 160 (step 344) after displaying a normal operation window (step 306) and of displaying limit information if a limitation is set (step 312) has been described above; however, the order of steps is not limited to this particular order. The image forming apparatus 100 may obtain the limiting condition from the server 160 before displaying the normal operation window. For example, when sending, to the image forming apparatus 100, the result of login authentication which is performed using the data sent thereto in step 340, the server 160 may send the limiting condition to the image forming apparatus 100 along with the authentication result (information indicating successful authentication) if authentication is successful and the limiting condition is set for the user ID. In this way, the image forming apparatus 100 can obtain the limiting condition before displaying the operation window. Such a configuration allows an operation window including the limit information to be displayed from the beginning if a limitation is set for the user.

The case where the image forming apparatus 100 determines whether to apply a limitation in step 310 has been described above; however, the configuration is not limited to this particular example. The server 160 may determine whether to apply a limitation by using the limiting condition identified from the received user ID and send limit information based on the result of the determination to the image forming apparatus 100. In such a case, the image forming apparatus 100 may send, to the server 160, information used to determine the limit information (such as copy settings and the total number of sheets printed) along with the user ID.

Third Embodiment

In the first and second embodiments, a limitation is set for the copy function of the image forming apparatus 100. In a third embodiment, a limitation is set for a print function.

Figure 15:
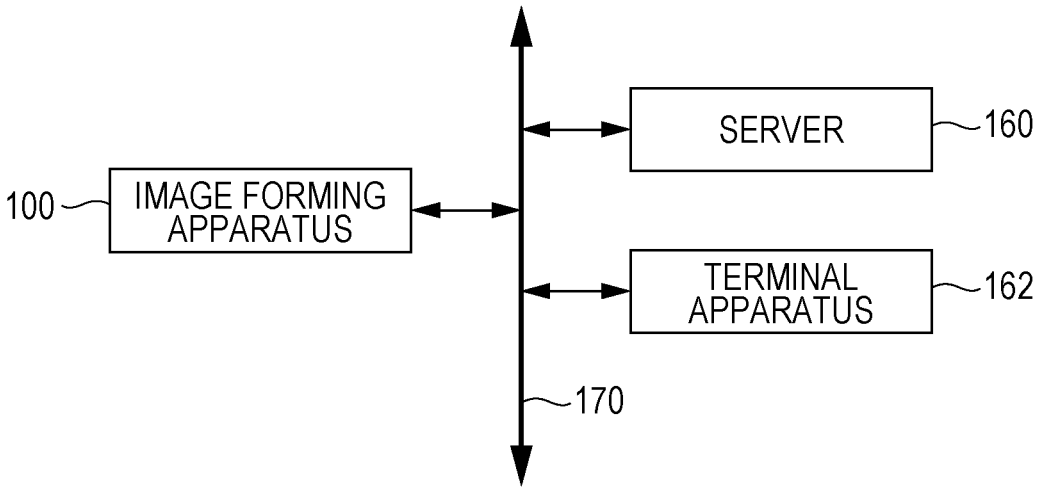
FIG. 15 is a block diagram illustrating a configuration of an image forming system according to a third embodiment of the present disclosure.

Referring to FIG. 15, an image forming system according to the third embodiment includes the image forming apparatus 100 configured in a manner as illustrated in FIG. 1, the server 160, a terminal apparatus 162, and the network 170 to which the image forming apparatus 100, the server 160, and the terminal apparatus 162 are connected. The image forming apparatus 100 is connected to the network 170 via the communication unit 110. The operation window illustrated in FIG. 2 is displayed on the operation unit 120 of the image forming apparatus 100 according to the third embodiment.

The server 160 manages the network 170 and stores sets of the user ID and the password in order to permit access to the network 170 from the terminal apparatus 162.

The terminal apparatus 162 is, for example, any available computer. The terminal apparatus 162 includes a CPU, a ROM, a RAM, an HDD, an NIC, a display unit, an operation unit, and a bus to which the CPU, the ROM, the HDD, the NIC, the display unit, and the operation unit are connected. The terminal apparatus 162 is connected to the network 170 via the NIC. The display unit includes a display device (liquid crystal display or cathode ray tube (CRT) display) capable of displaying an image. The operation unit includes, for example, a keyboard and a mouse.

A user operates the terminal apparatus 162 to input a print instruction to the image forming apparatus 100 after having passed login authentication performed by the server 160. A print job is then sent from the terminal apparatus 162 to the image forming apparatus 100 via the network 170. In the image forming apparatus 100, the image processing unit 118 renders the received print job to generate image data. The image forming unit 116 forms an image on a recording medium fed from the feeder unit in accordance with the image data and discharges the recording medium to the discharge tray.

FIG. 15 illustrates the terminal apparatus 162 alone as the terminal apparatus; however, terminal apparatuses other then the terminal apparatus 162 may be connected to the network 170. In addition, image forming apparatuses other than the image forming apparatus 100 may be connected to the network 170.

Figure 16:
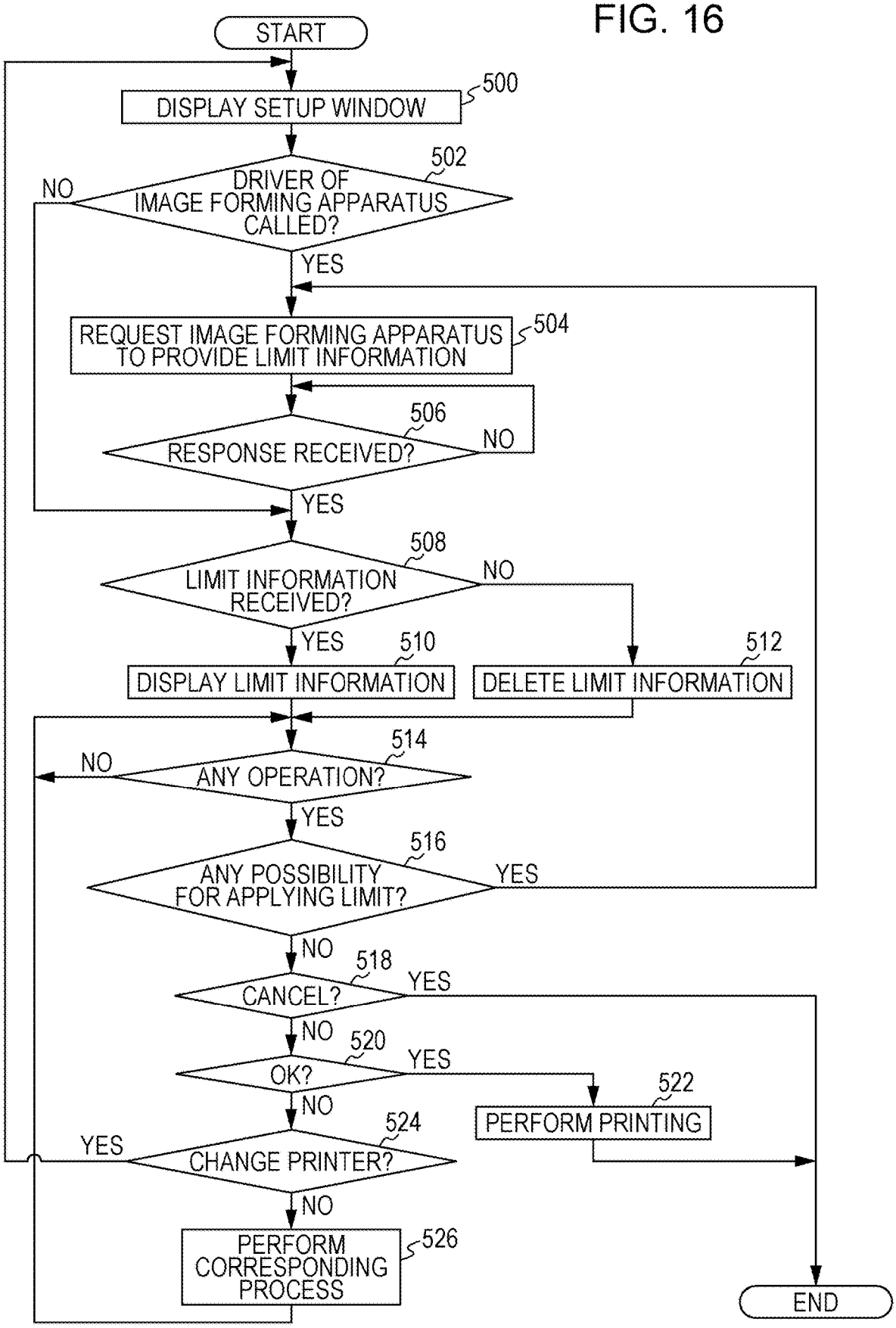
FIG. 16 is a flowchart illustrating a control flow of a program for displaying information indicating limitation, the program being executed by a terminal apparatus illustrated in FIG. 15.
Figure 17:
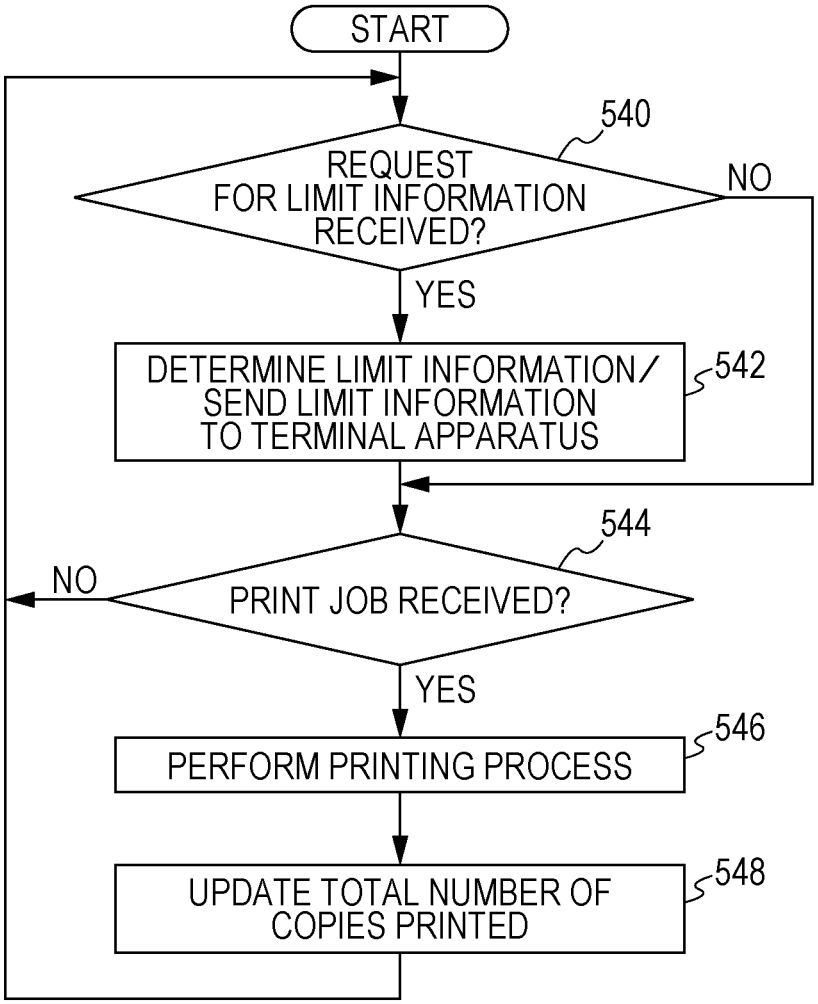
FIG. 17 is a flowchart illustrating a control flow of a program executed by an image forming apparatus illustrated in FIG. 15.

In the third embodiment, a program described in FIG. 16 is executed by the terminal apparatus 162, and a program described in FIG. 17 is executed by the image forming apparatus 100. The program described in FIG. 16 is executed by the CPU of the terminal apparatus 162.

As in the first embodiment, the image forming apparatus 100 stores, for each user ID, a limiting condition (the limited function specifying information and the limit parameter) regarding printing in association with the user ID in the HDD 108. In addition, the image forming apparatus 100 stores, for each user ID, the total number of recording media that have been used as a result of execution of received print jobs (the total number of sheets printed) in the HDD 108.

It is assumed that the user has input the user ID and the password by operating the terminal apparatus 162 and has passed login authentication performed by the server 160. The program described in FIG. 16 is started in the case where an application program (hereinafter, simply referred to as an application) executed by the terminal apparatus 162 displays a print setup window in response to a print instruction. The print instruction is given, for example, by selecting "Print" from among menu items displayed on the window of the executed application. It is assumed that a driver (software) for the image forming apparatus 100 is pre-installed in the terminal apparatus 162.

Figure 18:
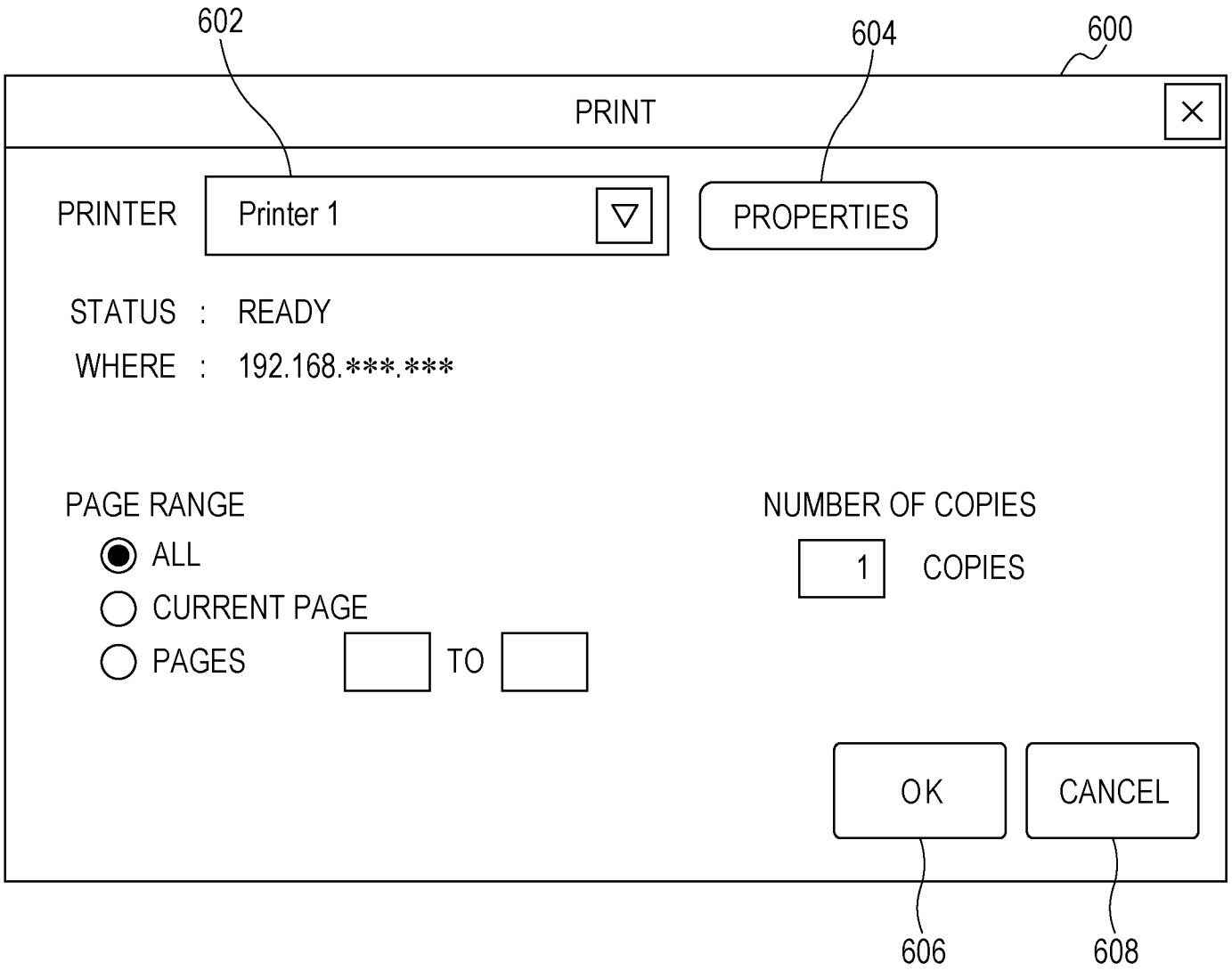
FIG. 18 is a diagram illustrating a print setup window displayed in the terminal apparatus.

In step 500, the terminal apparatus 162 displays the print setup window on the display unit. For example, a setup window 600 illustrated in FIG. 18 is displayed. Referring to FIG. 18, a printer selection area 602 displays the name of the currently selected printer. The printer is selected by a pulldown menu, for example. A properties key 604 is a key used to display properties (detailed settings) of the currently selected printer. The settings are changeable on the detailed setup window to be displayed. An OK key 606 is a key used to input an instruction to perform printing. A cancel key 608 is a key used to cancel printing.

In step 502, the terminal apparatus 162 determines whether to call the driver for the image forming apparatus 100. If the image forming apparatus 100 is set as a default printer of the terminal apparatus 162 or if the image forming apparatus 100 is selected through an operation at the printer selection area 602, it is determined that the driver for the image forming apparatus 100 is to be called, and the control process proceeds to step 504; otherwise, the process proceeds to step 508. It is assumed that "Printer 1" illustrated in FIG. 18 is the name of the image forming apparatus 100.

In step 504, the terminal apparatus 162 requests the image forming apparatus 100 to send limit information. Specifically, the terminal apparatus 162 sends a limit information request command, the user ID of the user who has passed login authentication and is currently permitted to use the terminal apparatus 162, and a dummy print job. The dummy print job is a print job generated in accordance with the current settings. The dummy print job is not a print job executed by the image forming apparatus 100 but data used by the image forming apparatus 100 in limitation-related processing. An address of the destination is an Internet Protocol (IP) address displayed at "WHERE" in FIG. 18.

Upon receipt of the limit information request command, the image forming apparatus 100 searches the database in the HDD 108 for the received user ID and sends information based on the search result to the terminal apparatus 162 (described later).

In step 506, the terminal apparatus 162 determines whether a response to the request sent in step 504 has been received. If the terminal apparatus 162 determines that the response has been received, the process proceeds to step 508; otherwise, step 506 is repeated.

In step 508, the terminal apparatus 162 determines whether the information received in step 506 is the limit information. If the received information is the limit information, the control process proceeds to step 510. If the received information is not the limit information, the control process proceeds to step 512. If no limitation is set for the used ID sent in step 504, the terminal apparatus 162 receives information indicating no corresponding limit information from the image forming apparatus 100.

Figure 19:
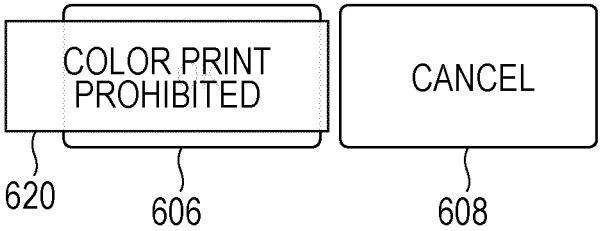
FIG. 19 is a diagram illustrating limit information displayed in the print setup window in the case where a user is prohibited from performing color printing.

In step 510, the terminal apparatus 162 displays the limit information received in step 506 over the OK key 606 in the setup window 600. For example, limit information 620 is displayed in a manner as illustrated in FIG. 19 as described later.

In step 512, the terminal apparatus 162 deletes the limit information displayed in the setup window 600. If no limit information is displayed in the setup window 600, the setup window 600 is maintained.

In step 514, the terminal apparatus 162 determines whether an operation is performed on the setup window 600 by using the operation unit. If it is determined that an operation has been performed, the control process proceeds to step 516; otherwise, step 514 is repeated.

In step 516, the terminal apparatus 162 determines whether there is a possibility that a limitation is applied, in accordance with the operation detected in step 514. If it is determined that there is a possibility that a limitation is applied, the control process returns to step 504; otherwise, the control process proceeds to step 518.

For example, if no limitation is set for the logged-in user of the terminal apparatus 162, that is, if limit information has not been received in step 508, the limitation is not applied. Thus, the control process proceeds to step 518. In the case where the limit information is displayed as illustrated in FIG. 19, a limitation may be applied when any of settings related to the limitation such as the page range (a range of pages to be printed), the number of copies to be printed, and selection of color printing or black-and-white printing is changed. Thus, the control process returns to step 504.

In step 518, the terminal apparatus 162 determines whether the operation detected in step 514 is selection of the cancel key 608. If it is determined that the cancel key 608 has been selected, the setup window 600 is hidden, and the program terminates; otherwise, the control process proceeds to step 520.

In step 520, the terminal apparatus 162 determines whether the operation detected in step 514 is selection of the OK key 606. If it is determined that the OK key 606 has been selected, the control process proceeds to step 522; otherwise, the control process proceeds to step 524.

In step 522, the terminal apparatus 162 performs printing. Specifically, the terminal apparatus 162 generates a print job in accordance with the current settings and sends the generated print job and the user ID of the currently logged-in user to the currently selected image forming apparatus 100. The setup window 600 is then hidden and the program terminates.

In step 524, the terminal apparatus 162 determines whether the operation detected in step 514 is an operation for changing the printer. If it is determined that the printer has been changed, the control process returns to step 500; otherwise, the control process proceeds to step 526.

In step 526, the terminal apparatus 162 performs a process corresponding to the operation detected in step 514. Then, the control process returns to step 514.

Referring to FIG. 17, in step 540 of the program executed by the image forming apparatus 100, the CPU 102 determines weather the limit information send request (request command) has been received. If it is determined that the limit information send request has been received, the control process proceeds to step 542; otherwise, the control process proceeds to step 544. As describe above, the terminal apparatus 162 sends the user ID and a dummy print job along with the request command at this time (step 504). Thus, when the request command is received, the user ID and the dummy print job are also received.

In step 542, the CPU 102 searches the HDD 108 for the user ID received in step 540. If the corresponding limiting condition is found, the CPU 102 sends the corresponding limit information to the terminal apparatus 162 that has sent the request command. If no corresponding limiting condition is found, the CPU 102 sends information indicating that no limitation is set for the user ID to the terminal apparatus 162.

The limit information is information displayed on the setup window 600 of the terminal apparatus 162 and is determined in a manner similar to that of the first embodiment. For example, suppose that a limit on the number of sheets permitted in color printing is set to 100 in the limiting condition for the received user ID. In such a case, if the current total number of sheets used in color printing associated with the user ID has reached 100, "COLOR PRINT LIMIT REACHED" is determined as the limit information. If the current total number of sheets used is less than 100, information indicating the number of remaining sheets permitted (difference between the limit and the current number of sheets printed) (e.g., "30 MORE COLOR PRINTED COPIES") is determined as the limit information. Additional information is also determined in accordance with whether the sum of the number of sheets to be used in the dummy print job received in step 540 and the current total number of sheets used exceeds 100. The additional information is sent to the terminal apparatus 162 along with the limit information. If the sum of the number of sheets to be used in the dummy print job received in step 540 and the current number of sheets used exceeds the limit (i.e., 100), certain information (e.g., "1") is determined as the additional information. If the sum does not exceed 100, information (e.g., "0") different from the information determined when the sum exceeds 100 is determined as the additional information. The additional information allows the terminal apparatus 162 to display the limit information according to the content thereof (described later).

If color printing is prohibited for the user ID received in step 540 and the received dummy print job is a color print job, "COLOR PRINT PROHIBITED" is determined as the limit information.

In step 544, the CPU 102 determines whether a print job has been received. If it is determined that a print job has been received, the control process proceeds to step 546; otherwise, the control process returns to step 540. The user ID is sent from the terminal apparatus 162 along with the print job (step 520), and thus the image forming apparatus 100 also receives the user ID.

In step 546, the CPU 102 performs a printing process in accordance with the print job received in step 544.

In step 548, the CPU 102 updates the total number of sheets printed by adding the number of sheets used in the printing process performed in step 546 to the current total number of sheets printed that is associated with the user ID received in step 544. Then, the control process returns to step 540.

The image forming apparatus 100 stores the total number of sheets printed, in accordance with limitation on printing. For example, in the case where the number of sheets permitted in color printing is limited, the image forming apparatus 100 stores the total number of sheets used in color printing.

How limit information is displayed by the programs of FIGS. 16 and 17 in the case where the image forming apparatus 100 is capable of limiting black-and-white printing and color printing for each user and where limitations are set for users A to C as illustrated in Table 2 will be described.

TABLE 2

| User name | Function to be limited | |
|---|---|---|
| | Black-and-white printing | Color printing |
| User A | — | Prohibited |
| User B | — | 100 |
| User C | Prohibited | Prohibited |

Referring to Table 2, "Black-and-white printing" and "Color printing" are functions specified by the limited function specifying information, and "100" is the limit parameter. "Prohibited" and "-" respectively indicate that the user is prohibited from using the function specified by the corresponding limited function specifying information and that the user is permitted to use the function specified by the corresponding limited function specifying information. The value "100" indicates the limit set for the function specified by the corresponding limited function specifying information, that is, the limit on the number of sheets permitted in color printing. The HDD 108 stores the limiting conditions, that is, sets of the limited function specifying information and the limit parameter in association with the user ID of each user. As the limiting condition, data is stored for cells other than cells with "-" (no limitation is applied for cells with "-"). The limit parameter is unnecessary for cells with "Prohibited", and thus an invalid limit parameter (e.g., "0") is stored for these cells. For example, {the user ID of the user A, Color printing, 0} is stored for the user A, {the user ID of the user B, Color printing, 100} is stored for the user B, and {the user ID of the user C, Black-and-white printing, 0, Color printing, 0} is stored for the user C.

Suppose that the user A has passed login authentication and is using the terminal apparatus 162. If the image forming apparatus 100 is selected as the printer when the user inputs a print instruction using the executed application, the user ID of the user A, a dummy print job, and a limit information request command are sent to the image forming apparatus 100 (step 504). In response to the request command, the image forming apparatus 100 determines the limit information from the received data and sends the limit information to the terminal apparatus 162 (step 542).

At this time, if the received dummy print job is a color print job, the image forming apparatus 100 determines "COLOR PRINT PROHIBITED" as the limit information (the user A is prohibited from performing color printing) and sends the limit information to the terminal apparatus 162. The terminal apparatus 162 displays the received limit information in the setup window 600. For example, the terminal apparatus 162 displays the limit information 620 over the OK key 606 as illustrated in FIG. 19. At this time, the OK key 606 is not selectable. Because the user A understands details about the limitation upon seeing the displayed limit information, the user can change the setting so as to avoid the limitation. In addition, in the case where user is permitted to submit a request to change the limitation to the administrator, the user can submit such a request by specifically indicating how the limitation is to be changed.

For example, the user A can change the setting from color printing to black-and-white printing by selecting the properties key 604. In such a case, it is determined in step 516 that there is a possibility that a limitation is applied. Accordingly, the user ID of the user A, a dummy print job (for black-and-white printing), and a limit information request command are sent (step 504). Because the received dummy print job is a black-and-white print job, the image forming apparatus 100 determines that there is no corresponding limit information (no limitation concerning black-and-white printing is set for the user A) and sends information indicating that no limitation is set to the terminal apparatus 162. Accordingly, the terminal apparatus 162 hides the limit information 620 from the setup window 600 (NO is obtained in step 508 and step 512 is performed). In this way, the user A is permitted to perform printing (black-and-white printing).

If the image forming apparatus 100 is selected as the printer and black-and-white printing is set when the user A inputs a print instruction using the executed application, a black-and-white print job is sent as a dummy print job to the image forming apparatus 100. In response to this, the image forming apparatus 100 sends information indicating that no limitation is set. Accordingly, the terminal apparatus 162 displays no limit information and the displayed setup window 600 is maintained (NO is obtained in step 508 and step 512 is performed). If the user A selects the properties key 604 and changes the setting to color printing thereafter, it is determined in step 516 that there is a possibility that a limitation is applied. Accordingly, the user ID of the user A, a dummy print job (for color printing), and a limit information request command are sent (step 504). In this way, the terminal apparatus 162 displays the limit information 620 as illustrated in FIG. 19 as in the above-described case.

Suppose that the user B has passed login authentication and is using the terminal apparatus 162. If the image forming apparatus 100 is selected as the printer when the user B inputs a print instruction using the executed application, the user ID of the user B, a dummy print job, and a limit information request command are sent to the image forming apparatus 100 (step 504). In response to the request command, the image forming apparatus 100 determines the limit information from the received data and sends the limit information to the terminal apparatus 162 (step 542).

Figure 20:
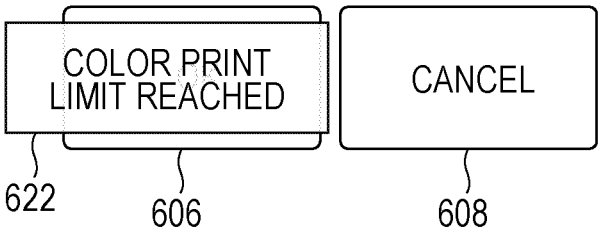
FIG. 20 is a diagram illustrating limit information displayed in the case where the number of sheets permitted for a certain user in color printing is limited and the limit has been reached.

If the received dummy print job is a color print job, the image forming apparatus 100 determines whether the current total number of sheets used in color printing, which is associated with the received user ID, exceeds 100 (the limit on the number of sheets permitted) (the limit on the number of sheets permitted in color printing is set to 100 for the user B). If the current total number of sheets used in color printing exceeds 100, the image forming apparatus 100 determines "COLOR PRINT LIMIT REACHED" as the limit information and sends the limit information to the terminal apparatus 162. The terminal apparatus 162 displays the received limit information in the setup window 600. For example, the terminal apparatus 162 displays limit information 622 over the OK key 606 as illustrated in FIG. 20. At this time, the OK key 606 is not selectable.

Figure 21:
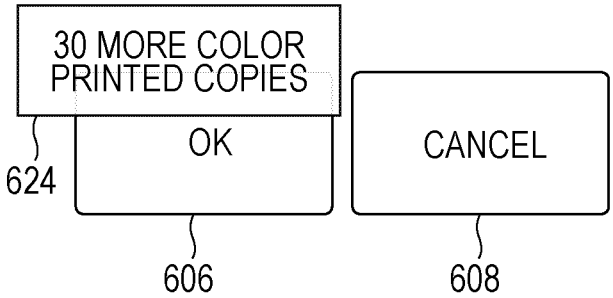
FIG. 21 is a diagram illustrating limit information displayed in the case where the number of sheets permitted for a certain user in color printing is limited and the limit will not be reached even if a print job is executed.

If the total number of sheets does not exceed the limit even after the number of sheets to be used in the received dummy print job is added, the image forming apparatus 100 determines the number of remaining sheets permitted (e.g., "30 MORE COLOR PRINTED COPIES") as the limit information, determines "0" as the additional information, and sends the limit information and the additional information to the terminal apparatus 162. The terminal apparatus 162 displays the received limit information on the setup window 600. Because the additional information is "0", limit information 624 is displayed over the OK key 606 as illustrated in FIG. 21, for example. At this time, the OK key 606 is selectable.

Figure 22:
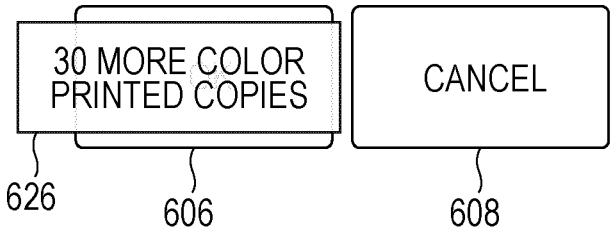
FIG. 22 is a diagram illustrating limit information displayed in the case where the number of sheets permitted for a certain user in color printing is limited and the limit will be reached if a print job is executed.

If the current total number of sheets printed that is associated with the received user ID does not exceed the limit (100) but the sum of the current total number of sheets printed and the number of sheets to be used in the received dummy print job exceeds the limit, the image forming apparatus 100 determines the number of remaining sheets permitted (e.g., "30 MORE COLOR PRINTED COPIES") as the limit information, determines "1" as the additional information, and sends the limit information and the additional information to the terminal apparatus 162. The terminal apparatus 162 displays the received limit information on the setup window 600. Because the additional information is "1", limit information 626 is displayed over the OK key 606 as illustrated in FIG. 22, for example. At this time, the OK key 606 is not selectable.

Suppose that the user C has passed login authentication and is using the terminal apparatus 162. If the image forming apparatus 100 is selected as the printer when the user C inputs a print instruction using the executed application, the user ID of the user C, a dummy print job, and a limit information request command are sent to the image forming apparatus 100 (step 504). In response to the request command, the image forming apparatus 100 determines the limit information from the received data and sends the limit information to the terminal apparatus 162 (step 542).

Figure 23:
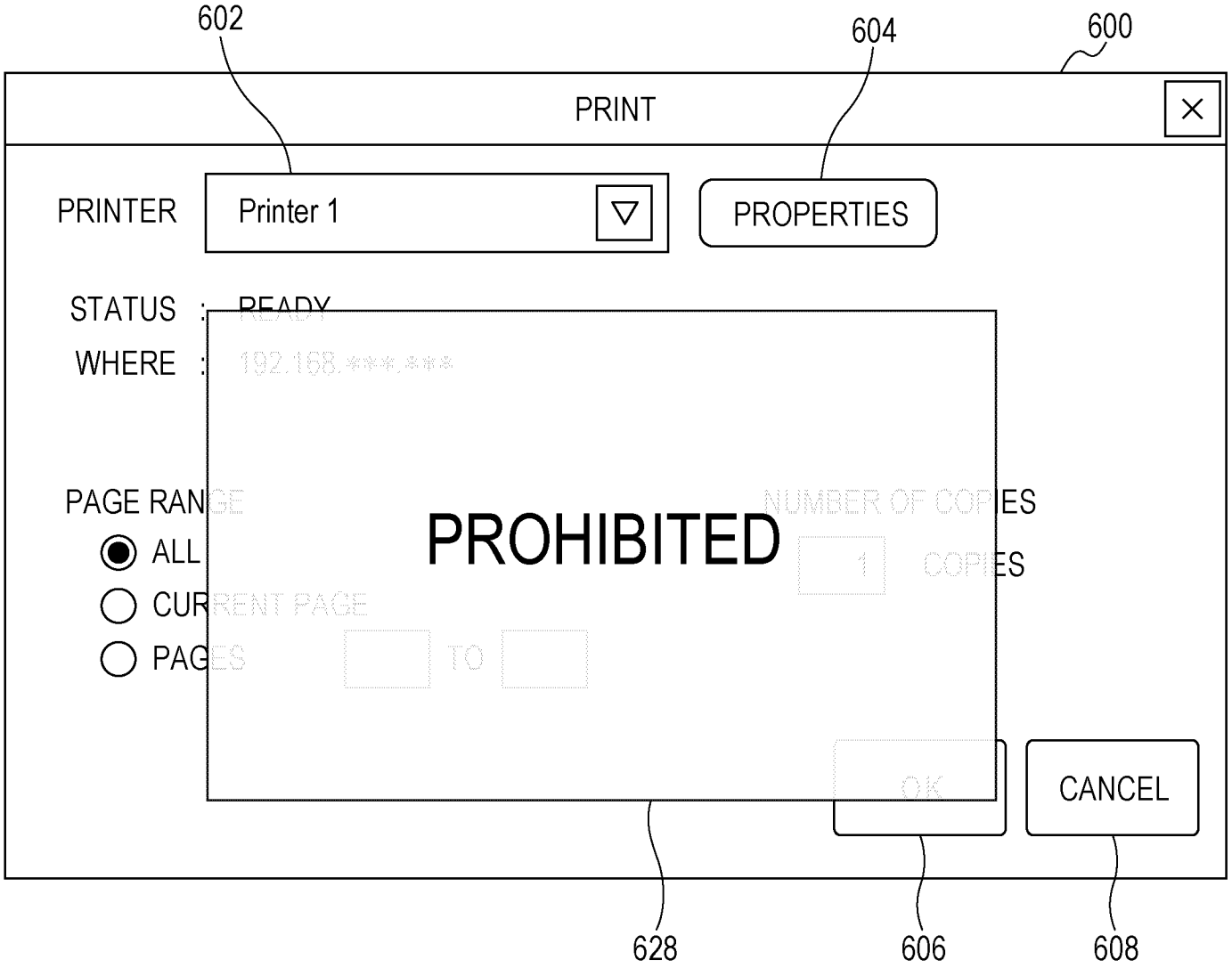
FIG. 23 is a diagram illustrating limit information displayed in the print setup window in the case where a certain user is prohibited from performing printing.

The image forming apparatus 100 determines "PROHIBITED" as the limit information (the user C is prohibited from using the print function) and sends the limit information to the terminal apparatus 162. The terminal apparatus 162 displays the received limit information on the setup window 600. For example, limit information 628 is displayed as illustrated in FIG. 23. At this time, the cancel key 608 and the printer selection area 602 are selectable but the other areas are not selectable. Accordingly, the user C understands details about the limitation upon seeing the displayed limit information and thus can change the setting so as to avoid the limitation. For example, the user C may select a printer other than the image forming apparatus 100 by operating the printer selection area 602. In this way, YES is obtained in the determination of step 524 and step 500 is performed in which a setup window not including limit information is displayed. In addition, in the case where user is permitted to submit a request to change the limitation to the administrator, the user C can submit such a request by specifically indicating how the limitation is to be changed.

Suppose that a user other than the users A, B, and C has passed login authentication, is using the terminal apparatus 162, and inputs a print instruction using the executed application. In such a case, the terminal apparatus 162 receives information indicating that no limitation is set from the image forming apparatus 100, and the setup window not including the limit information is displayed.

As described above, if a setting for limiting the use of the print function of the image forming apparatus 100 is set for a logged-in user who is using the terminal apparatus 162, the terminal apparatus 162 is capable of displaying limit information so that the user can understand details about the limitation. Because the user can understand details about the limitation upon seeing the displayed limit information, the user can change the setting to avoid the limitation. In addition, in the case where the user is permitted to submit a request to change the limitation to the administrator, the user can submit such a request by specifically indicating how the limitation is to be changed.

The programs described with reference to FIGS. 16 and 17 may be executed in various modified manners. For example, the case of sending a dummy print job in step 504 has been described above; however, the information to be sent is not limited to this particular information. For example, any information that allows the image forming apparatus 100 to determine the limit information, such as information regarding the page range to be printed, information regarding the number of copies to be printed, information regarding N-in-1 printing, information regarding two-sided printing, or information regarding the type of printing (color or black-or-white printing), among print settings may be sent.

In addition, the terminal apparatus 162 may request the image forming apparatus 100 to send the limiting condition instead of the limit information. In such a case, the image forming apparatus 100 may send the limiting condition associated with the received user ID and the total number of sheets printed to the terminal apparatus 162. Such a configuration allows the terminal apparatus 162 to determine the limit information from the limiting condition and the total number of sheets printed that have been received and the print settings and to display the limit information on the setup window 600. If no limiting condition is stored in association with the received user ID, the image forming apparatus 100 may send information indicating that no limitation is set to the terminal apparatus 162. In such a case, the terminal apparatus 162 displays no limit information on the setup window 600.

The case where the image forming apparatus 100 stores the limiting condition for each user has been described above; however, the limiting condition may be stored in the server 160 for each user as in the second embodiment. In such a case, the terminal apparatus 162 may request the server 160 to send the limit information and the server 160 may send the limit information or information indicating that no limitation is set to the terminal apparatus 162.

The case of displaying the limit information over the key (OK key) for an instruction to perform printing on the print setup window 600 which is displayed in response to selection of printing in the application has been described above; however, the window displaying the limit information is not limited to this particular window. The limit information may be displayed on a detailed setup window which is displayed in response to selection of the properties key 604. For example, the limit information illustrated in FIGS. 19 to 22 may be displayed over an area for setting the type of printing (color or black-and-white printing) on the detailed setup window. For example, the limit information is displayed for a user who is prohibited from performing color printing such that color printing is not selectable.

The case of limiting the number of sheets separately for copying and printing has been described in the first to third embodiments above; however, the configuration is not limited to this particular example. A single limit may be set for the number of sheets and the limit for the number of sheets may be applied to both copying and printing without distinction as long as the image forming system is configured in a manner as illustrated in FIG. 15.

The case of limiting the copy function and the print function has been described in the first to third embodiments above; however, the function to be limited is not limited to these particular functions. The scan function may be limited. In addition, in an image forming apparatus having the fax function, the fax function may be limited.

The present disclosure has been described through the description of the embodiments; however, the embodiments above are merely illustrative, and the present disclosure is not limited to the embodiments described above and can be carried out in various modified manners.

The present disclosure contains subject matter related to that disclosed in Japanese Priority Patent Application JP 2014-180481 filed in the Japan Patent Office on Sep. 4, 2014, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus having a user authentication function and able to limit use of the image forming apparatus by a user who has passed user authentication, the image forming apparatus comprising:

a storage that stores a limiting condition set for each user, the limiting condition being a condition for limiting use of the image forming apparatus;

an input that accepts input of an instruction from the user;

a display; and a controller; wherein the controller determines, in response to the input accepting the instruction from the user, whether the storage stores a limiting condition set for the user;

the controller controls the display to display, in response to the controller determining that the storage stores the limiting condition set for the user, limit information indicating details about a limitation corresponding to the limiting condition determined to be stored in the storage;

the storage is able to store, for each user, a plurality of limiting conditions;

when the limiting condition includes information for limiting a number of sheets to be printed, the controller controls the display to display a start key differently from how the start key is displayed when the limiting condition does not include the information for limiting the number of sheets to be printed; and when the input receives the instruction from the user and the controller determines that the storage stores the limiting condition set for the user, the controller controls the display to display the limit information before an instruction to start printing via the start key is received.

2. The image forming apparatus according to claim 1, wherein the limiting condition includes type specifying information that specifies a type of printing performed by the image forming apparatus; and when the limiting condition includes the information for limiting the number of sheets to be printed and the type specifying information, the controller controls the display to display the limit information differently from how the limit information is displayed when the limiting condition does not include the information for limiting the number of sheets to be printed and the type specifying information.

3. The image forming apparatus according to claim 2, wherein the controller calculates, for each user, the total number of recording media on which printing has been performed in response to one or more instructions to perform the type of printing specified by the type specifying information;

the limiting condition set for the user from whom the input has received the instruction includes an upper limit on the number of sheets printed, and the controller controls the display to display, as the limit information, a value obtained by subtracting from the upper limit the total number of recording media corresponding to the user from whom the input has received the instruction.

4. The image forming apparatus according to claim 3, wherein the controller calculates the number of originals that are to be processed by the image forming apparatus;

the controller calculates, in response to the input accepting an instruction to execute a job for copying the original, an estimate of the total number of recording media that will be reached if the job is executed from the number of originals calculated by the controller and a setting of the job; and the controller controls the display to display, as the limit information, a value obtained by subtracting the estimate from the upper limit.

5. The image forming apparatus according to claim 1, wherein the start key is grayed out when the limiting condition includes the information for limiting the number of sheets to be printed.

6. The image forming apparatus according to claim 1, wherein the limit information overlaps the start key when the limiting condition includes the information for limiting the number of sheets to be printed.

7. The image forming apparatus according to claim 1, wherein the limit information partially overlaps the start key when the limiting condition includes the information for limiting the number of sheets to be printed.

8. The image forming apparatus according to claim 1, wherein, when the input receives the instruction from the user and the controller determines that the storage stores the limiting condition set for the user, the controller controls the display to display the limit information before the instruction to start printing via the start key is received and after the user authentication is completed.

9. The image forming apparatus according to claim 1, wherein the controller controls the display to display a number of remaining sheets permitted to be printed by the user in response to receiving the instruction to start printing via the start key when the instruction to start printing would result in a total printed number of sheets being greater than the number of sheets permitted to be printed by the user.

10. A system comprising:

an image forming apparatus;

a server computer having a user authentication function;

the image forming apparatus including:

an input that accepts input of a user identity, a communication interface that sends the input user identity to the server computer and receives information associated with the user identity from the server computer, a display, and a controller; and the server computer including a storage that stores, for each user identity, a limiting condition for limiting use of the image forming apparatus; wherein the server computer receives the user identity sent from the image forming apparatus and sends the limiting condition stored in association with the received user identity to the image forming apparatus;

the controller determines whether the communication interface has received the limiting condition;

the controller controls the display to display, in response to the controller determining that the communication interface has received the limiting condition, limit information indicating details about a limitation corresponding to the limiting condition determined to be received;

the storage included in the server computer is able to store, for each user identity, a plurality of limiting conditions;

when the limiting condition includes information for limiting a number of sheets to be printed, the controller controls the display to display a start key differently from how the start key is displayed when the limiting condition does not include the information for limiting the number of sheets to be printed; and when the input receives the input of the user identity and the controller determines that the communication interface has received the limiting condition, the controller controls the display to display the limit information before an instruction to start printing via the start key is received.

11. A server computer able to limit use of an image forming apparatus by a user who has passed user authentication, the server computer comprising:

a storage that stores, for each user identity, a limiting condition for limiting use of the image forming apparatus; wherein the server computer receives a user identity from the image forming apparatus;

the server computer determines whether the storage stores a limiting condition in association with the user identity received from the image forming apparatus;

the server computer sends, to the image forming apparatus that includes a display, in response to the server computer determining that the storage stores the limiting condition in association with the user identity, limit information indicating details about a limitation corresponding to the limiting condition determined to be stored in the storage;

the server computer sends, to the image forming apparatus, the limiting condition in association with the user identity;

the storage is able to store, for each user identity, a plurality of limiting conditions, and when the limiting condition sent by the server computer to the image forming apparatus includes information for limiting a number of sheets to be printed, the limiting condition causes a controller included in the image forming apparatus to control the display of the image forming apparatus to display a start key differently from how the start key is displayed when the limiting condition does not include the information for limiting the number of sheets to be printed; and when the server computer determines that the storage stores the limiting condition in association with the user identity and the server computer sends the limiting condition in association with the user identity to the image forming apparatus, the controller included in the image forming apparatus controls the display of the image forming apparatus to display the limit information before an instruction to start printing via the start key is received.

12. A terminal apparatus that gives a print instruction to an image forming apparatus having a print function for which a plurality of limitations are settable for each user, the terminal apparatus comprising:

an input that accepts input of an instruction from a user;

a display that displays a print setup window in response to the input accepting a print instruction from the user;

a communication interface; and a controller; wherein the communication interface sends, in response to the input accepting the print instruction from the user, a user identity of the user and a print setting to the image forming apparatus;

the communication interface receives, from the image forming apparatus, limit information indicating details about a limitation of the print function set in association with the user identity sent by the communication interface;

the controller controls the display to display the limit information received by the communication interface in the print setup window;

when the limit information includes information for limiting a number of sheets to be printed by the image forming apparatus, the controller controls the display to display in the print setup window a key used to input an instruction to perform printing differently from how the display displays the key in the print setup window when the limit information does not include the information for limiting the number of sheets to be printed by the image forming apparatus; and when the input receives the instruction from the user and the communication interface receives the limit information from the image forming apparatus, the controller controls the display to display the limit information before the instruction to perform printing is able to be input via the key.

13. A method for displaying limit information indicating details about a limitation in an image forming apparatus that is able to limit use of the image forming apparatus by a user who has passed user authentication, the method comprising:

performing user authentication;

setting, for each user, one of more limiting conditions for limiting use of the image forming apparatus;

accepting input of an instruction from the user;

determining, in response to acceptance of the instruction from the user, whether the one or more limiting conditions are set for the user;

displaying on a display of the image forming apparatus, in response to the one or more limiting conditions being determined to be set for the user, the limit information indicating details about a limitation corresponding to the one or more limiting conditions determined to be set for the user; wherein when the one or more limiting conditions include information for limiting a number of sheets to be printed, displaying a start key on the display of the image forming apparatus differently from how the start key is displayed on the display of the image forming apparatus when the one or more limiting conditions do not include the information for limiting the number of sheets to be printed; and when the instruction from the user is received and the one or more limiting conditions are determined to be set for the user, displaying the limit information before receiving an instruction to start printing via the start key.

* * * * *